US010883463B2

(12) United States Patent
Koshimoto et al.

(10) Patent No.: US 10,883,463 B2
(45) Date of Patent: Jan. 5, 2021

(54) HIGH PRESSURE PUMP

(71) Applicant: DENSO CORPORATION, Kariya (JP)

(72) Inventors: Shinichiro Koshimoto, Kariya (JP); Masaharu Nakaoka, Kariya (JP); Shinobu Oikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 43 days.

(21) Appl. No.: 16/096,442

(22) PCT Filed: Mar. 30, 2017

(86) PCT No.: PCT/JP2017/013165
§ 371 (c)(1),
(2) Date: Oct. 25, 2018

(87) PCT Pub. No.: WO2017/187876
PCT Pub. Date: Nov. 2, 2017

(65) Prior Publication Data

US 2019/0145364 A1 May 16, 2019

(30) Foreign Application Priority Data

Apr. 28, 2016 (JP) ..... 2016-90327

(51) Int. Cl.
*F02M 55/04* (2006.01)
*F02M 59/36* (2006.01)
(Continued)

(52) U.S. Cl.
CPC ..... *F02M 55/04* (2013.01); *F02M 55/00* (2013.01); *F02M 59/36* (2013.01); *F02M 59/44* (2013.01);
(Continued)

(58) Field of Classification Search
CPC ..... F02M 55/04; F02M 59/44; F02M 55/00; F02M 59/46; F02M 59/36; F02M 2200/30; F02M 55/008
(Continued)

(56) References Cited

U.S. PATENT DOCUMENTS 6,062,830 A * 5/2000 Kikuchi ..... F02M 55/04 417/540
6,135,734 A 10/2000 Isozumi et al.
(Continued)

FOREIGN PATENT DOCUMENTS

JP 2004-138071 5/2004
JP 2014-105669 6/2014
(Continued)

OTHER PUBLICATIONS

"NPL_GM_LT4_GDI_HighPressureFuelPump_Published Jun. 11, 2015"; Published to the Internet Jun. 11, 2015; URL: https://www.corvetteforum.com/forums/c7-tech-performance/3665433-lt4-z06-fuel-pump-installation-upgrade-for-lt1.html; Retrieved from the Internet Jan. 24, 2020. (Year: 2015).*
(Continued)

*Primary Examiner* — Sizo B Vilakazi
*Assistant Examiner* — Brian R Kirby
(74) *Attorney, Agent, or Firm* — Nixon & Vanderhye P.C.

(57) ABSTRACT

A housing-includes a pressurizing chamber. A plunger is moved to increase and decrease a volume of the pressurizing chamber, so that the plunger can pressurize the fuel in the pressurizing chamber. A fuel chamber forming portion is placed on a radially outer side of the plunger and forms a fuel chamber that is communicated with the pressurizing chamber. A pulsation damper is placed in an inside of the fuel chamber and is operable to reduce pressure pulsation of the fuel in the fuel chamber. Fixable portions are placed on
(Continued)

a radially outer side of the plunger while each of the fixable portions includes a receiving through-hole. The fixable portions are fixed to an engine with bolts, which are provided to correspond with the receiving through-holes, respectively. The fuel chamber forming portion is displaced from axes of the receiving through-holes.

17 Claims, 14 Drawing Sheets

(51) Int. Cl.
*F02M 59/46* (2006.01)
*F02M 55/00* (2006.01)
*F02M 59/44* (2006.01)

(52) U.S. Cl.
CPC ..... *F02M 59/46* (2013.01); *F02M 55/008* (2013.01); *F02M 2200/30* (2013.01)

(58) Field of Classification Search
USPC ..... 123/446
See application file for complete search history.

(56) References Cited

U.S. PATENT DOCUMENTS 6,209,525 B1 * 4/2001 Konishi ..... F02M 55/04 123/458
6,647,963 B2 * 11/2003 Onishi ..... F02M 55/04 123/446
6,874,474 B2 * 4/2005 Fuchs ..... F02M 59/02 123/446
6,901,912 B1 * 6/2005 Onishi ..... F02M 55/04 123/447
7,124,738 B2 * 10/2006 Usui ..... F02M 55/04 123/446
7,152,583 B2 * 12/2006 Abe ..... F02M 55/04 123/446
7,540,274 B2 * 6/2009 Yamada ..... F02M 63/0035 123/506
7,870,871 B1 * 1/2011 Hanjagi ..... F02M 55/04 138/30
8,366,421 B2 * 2/2013 Munakata ..... F02M 59/367 417/540
8,419,391 B2 * 4/2013 Inoue ..... F04B 1/053 417/540
8,985,968 B2 * 3/2015 Matsumoto ..... F02M 59/46 417/415
9,777,879 B2 * 10/2017 Fujita ..... F04B 53/002
2005/0019188 A1 1/2005 Usui et al.
2007/0079810 A1 4/2007 Usui et al.
2008/0175735 A1 * 7/2008 Lucas ..... F02M 37/0041 417/540
2008/0213112 A1 * 9/2008 Lucas ..... F02M 59/48 417/471
2010/0126474 A1 5/2010 Siegel et al.
2011/0129363 A1 * 6/2011 Sakai ..... F02M 59/34 417/289
2011/0253109 A1 10/2011 Usui et al.
2013/0052064 A1 * 2/2013 Oikawa ..... F04B 11/0016 417/540
2016/0195084 A1 * 7/2016 Koehler ..... F02M 55/04 92/143
2016/0258427 A1 9/2016 Suda
2017/0037822 A1 * 2/2017 Yagai ..... F02M 59/34
2017/0254305 A1 * 9/2017 Lucas ..... F02M 59/466
2018/0328328 A1 * 11/2018 Kashiwagi ..... F02M 59/46
2019/0032615 A1 * 1/2019 Haupt ..... F02M 59/025

FOREIGN PATENT DOCUMENTS

JP 5616246 10/2014
JP 2016-17498 2/2016

OTHER PUBLICATIONS

NPL_AlokDiesel_StanadyneGDIPump_Published_2014; retrieved from the internet Jun. 24, 2020; URL:http://www.alok-diesel.com/gasolinedirectinjection.html ; (Year: 2014).*

* cited by examiner

HIGH PRESSURE PUMP

CROSS REFERENCE TO RELATED APPLICATION

This application is the U.S. national phase of International Application No. PCT/JP2017/013165 filed Mar. 30, 2017, which designated the U.S. and claims priority to Japanese Patent Application No. 2016-90327 filed on Apr. 28, 2016, the entire contents of each of which are hereby incorporated by reference.

TECHNICAL FIELD

The present disclosure relates to a high pressure pump that pressurizes fuel and discharges the pressurized fuel.

BACKGROUND ART

Previously, there is known a high pressure pump to be installed to an internal combustion engine while the high pressure pump pressurizes fuel and supplies the pressurized fuel to the internal combustion engine. For example, the high pressure pump of the patent literature 1 includes fixable portions that project outwardly from an outer wall of a housing and are fixed to the internal combustion engine. Each of the fixable portions includes a through-hole that has an axis, which is parallel to an axis of a plunger. Fixing members are respectively inserted through the through-holes and are threadably fixed to the internal combustion engine, so that the fixable portions are fixed to the internal combustion engine.

The high pressure pump of the patent literature 1 includes a pulsation damper that is placed in an inside of a fuel chamber communicated with a pressurizing chamber to damp pressure pulsation of the fuel in the inside of the fuel chamber. Here, the fuel chamber and the pulsation damper are located along the axis of the plunger. Furthermore, the pulsation damper is shaped into a hollow circular disk form and has an axis that is parallel to the axis of the plunger. The number of the through-holes of the fixable portions is two, and these two through-holes are symmetrical to each other with respect to the axis of the plunger that serves as an axis of symmetry. Therefore, in a case where an outer diameter of a fuel chamber forming portion, which forms the fuel chamber, or an outer diameter of the pulsation damper is larger than a distance between the two through-holes, a tool, which is used to threadably fix the fixing members to the internal combustion engine, may possible interfere with the fuel chamber forming portion, and thereby the installation of the high pressure pump to the internal combustion engine may possibly become difficult.

In a case where the outer diameter of the fuel chamber forming portion is reduced to limit the interference of the tool with the fuel chamber forming portion, it is required to reduce the outer diameter of the pulsation damper. Therefore, there is a possibility of that sufficient damping effect for damping the pressure pulsation cannot be achieved. In contrast, in a case where the outer diameter of the pulsation damper is increased to achieve the sufficient pressure pulsation reducing effect, the outer diameter of the fuel chamber forming portion is also increased. Thereby, the distance between the two through-holes needs to be increased. In this way, the size of the high pressure pump may be disadvantageously increased.

CITATION LIST

Patent Literature

PATENT LITERATURE 1: JP5616246B2

SUMMARY OF INVENTION

The present disclosure is made in view of the above points, and it is an objective of the present disclosure to provide a compact high pressure pump that achieve good pressure pulsation reducing effect for reducing pressure pulsation of fuel in a fuel chamber and can be easily installed to an internal combustion engine.

According to the present disclosure, there is provided a high pressure pump configured to be installed to an internal combustion engine to pressurize, discharge and supply fuel to the internal combustion engine. The high pressure pump includes a housing, a plunger, a fuel chamber forming portion, a pulsation damper, a discharge portion and a fixable portion.

The housing includes a pressurizing chamber.

The plunger is movable in such a manner that the plunger increases and decreases a volume of the pressurizing chamber upon movement of the plunger, and thereby the plunger is operable to pressurize the fuel in the pressurizing chamber.

The fuel chamber forming portion is placed on a radially outer side of the plunger and forms a fuel chamber that is communicated with the pressurizing chamber.

The pulsation damper is placed in an inside of the fuel chamber and is operable to reduce pressure pulsation of the fuel in the fuel chamber.

The discharge portion discharges the fuel, which is pressurized in the pressurizing chamber.

The fixable portion is placed on the radially outer side of the plunger and includes a receiving through-hole while the fixable portion is configured to be fixed to the internal combustion engine with a fixing member that is formed to correspond with the receiving through-hole.

In the present disclosure, the fuel chamber forming portion is placed at a location that is displaced from an axis of the receiving through-hole. Thus, it is possible to limit interference of a tool, which is used to fix the fixable portion of the high pressure pump to the internal combustion engine with the fixing member, relative to the fuel chamber forming portion. In this way, the installation of the high pressure pump to the internal combustion engine is eased.

Furthermore, according to the present disclosure, the fuel chamber forming portion is placed on the radially outer side of the plunger, so that even when the size of the fuel chamber forming portion is increased, the fuel chamber forming portion is less likely to interfere with the axis of the through-hole. Therefore, according to the present disclosure, the size of the fuel chamber forming portion can be increased while avoiding the interference of the fuel chamber forming portion with the axis of the through-hole. Thus, the size of the pulsation damper can be increased while limiting the interference between the tool and the fuel chamber forming portion at the time of fixing the fixable portion with the fixing member. Thereby, it is possible to provide the good pressure pulsation reducing effect for reducing the pressure pulsation of the fuel in the fuel chamber.

Also, according to the present disclosure, the fuel chamber forming portion is placed at the location that is radially outwardly displaced from the axis of the receiving through-hole in the radial direction of the plunger. Therefore, the receiving through-hole can be placed at the corresponding location that is relatively close to the axis of the plunger. Therefore, it is possible to reduce the size of the high pressure pump that includes the fixable portion, in which the receiving through-hole is formed.

In the case where the fuel chamber forming portion is placed at the location, which is displaced from an imaginary tubular surface that includes all of an inner wall of the through-hole, it is possible to further effectively limit the interference of the tool, which is used to fix the fixable portion of the high pressure pump to the internal combustion engine with the fixing member, relative to the fuel chamber forming portion.

BRIEF DESCRIPTION OF DRAWINGS

The present disclosure, together with additional objectives, features and advantages thereof, will be best understood from the following description in view of the accompanying drawings.

DESCRIPTION OF EMBODIMENTS

Hereinafter, various embodiments of the present disclosure will be described with reference to the accompanying drawings. In the following embodiments, substantially identical constituent parts are indicated by the same reference signs and will not be described redundantly for the sake of simplicity. In the following embodiments, the substantially identical constituent parts have the identical or similar effects and advantages.

First Embodiment

Figure 2:
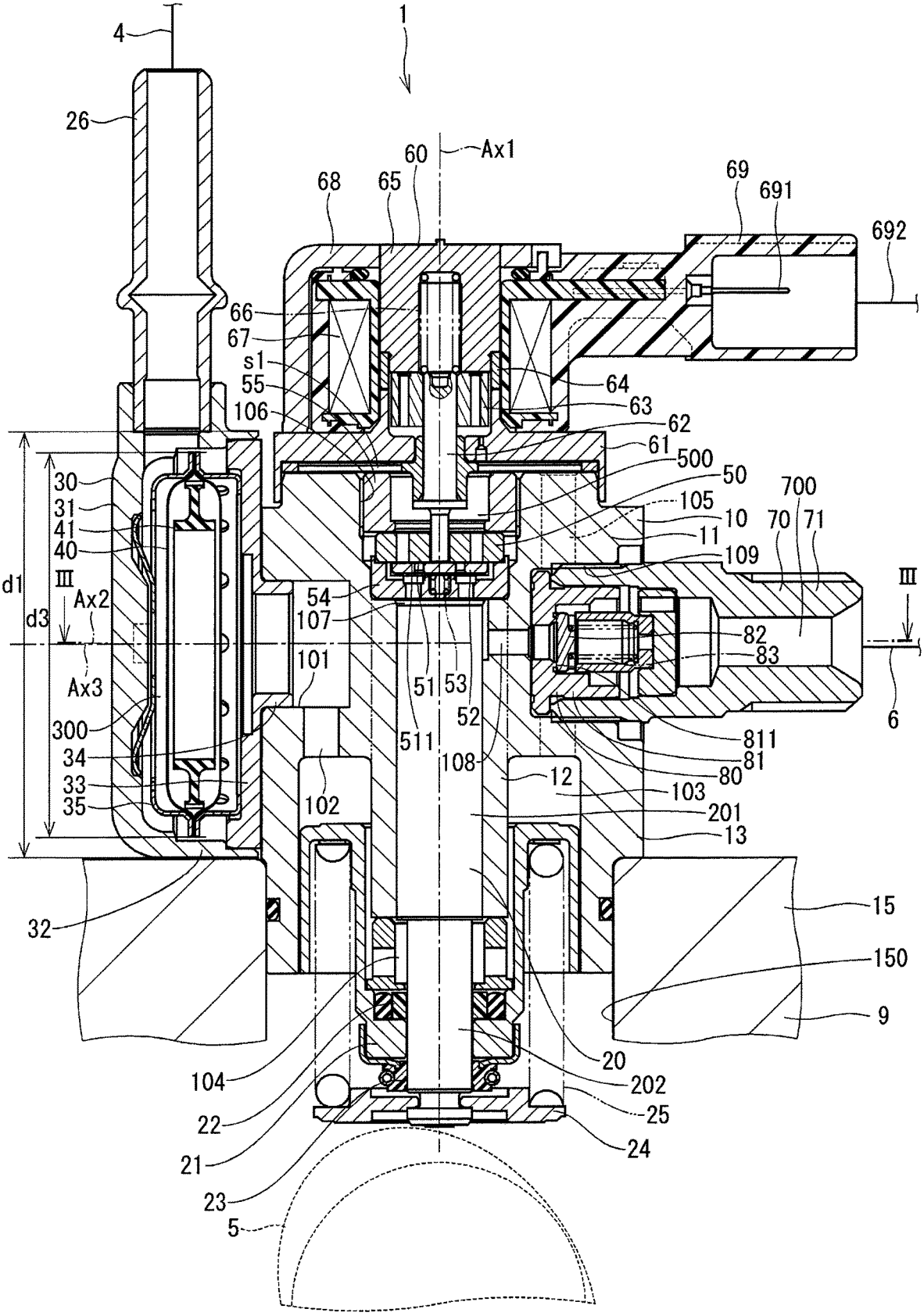
FIG. 2 is a cross-sectional view of the high pressure pump according to the first embodiment of the present disclosure.
Figure 3:
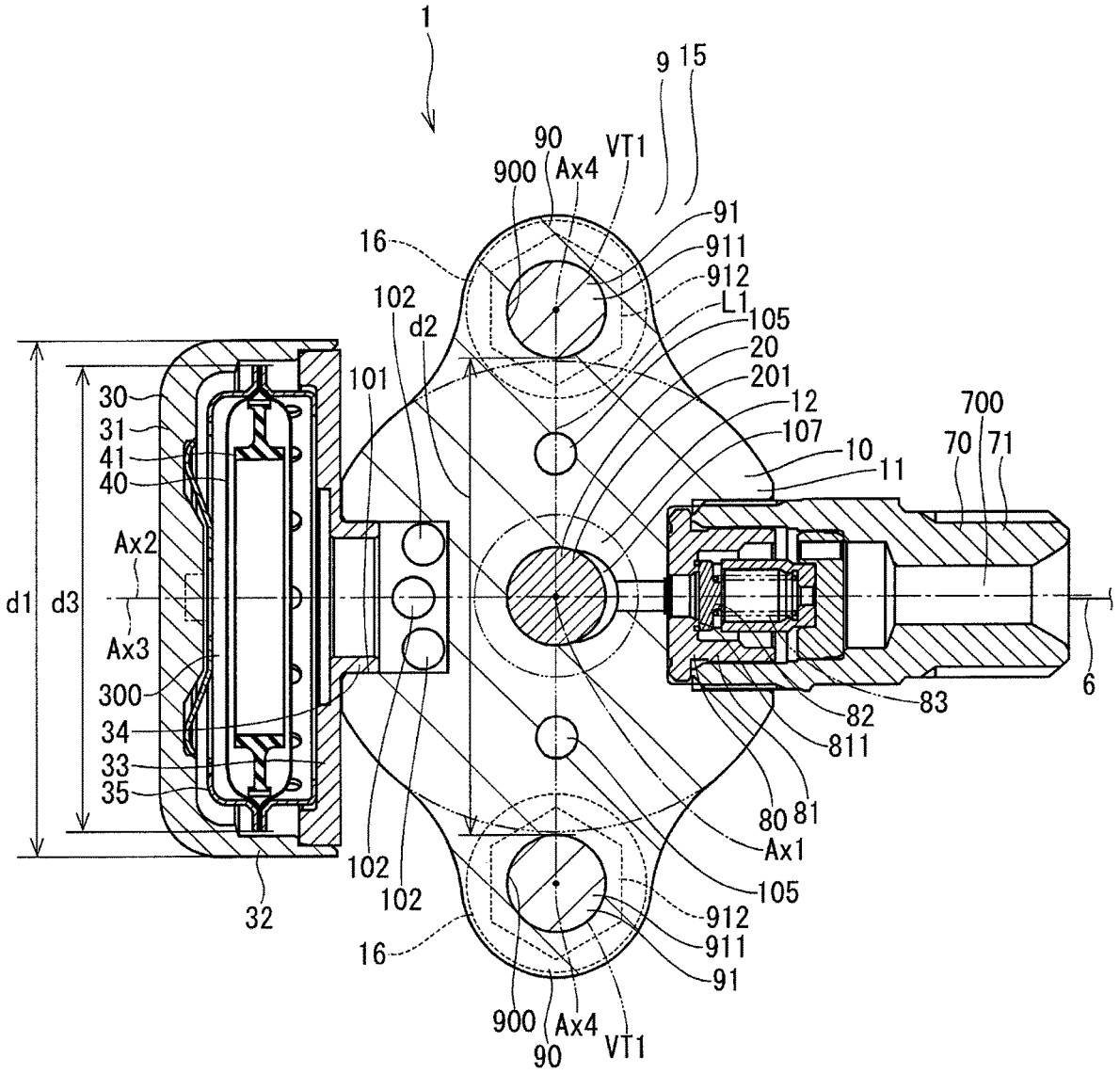
FIG. 3 is a cross-sectional view taken along line III-III in FIG. 2.

FIGS. 2 and 3 show a high pressure pump according to a first embodiment of the present disclosure.

The high pressure pump 1 is installed to a vehicle (not shown). The high pressure pump 1 is a pump that supplies the fuel at a high pressure to, for example, an engine 9 that serves as an internal combustion engine. The fuel, which is supplied from the high pressure pump 1 to the engine 9, is, for example, gasoline. That is, a fuel supply subject of the high pressure pump 1 is a gasoline engine.

Figure 1:
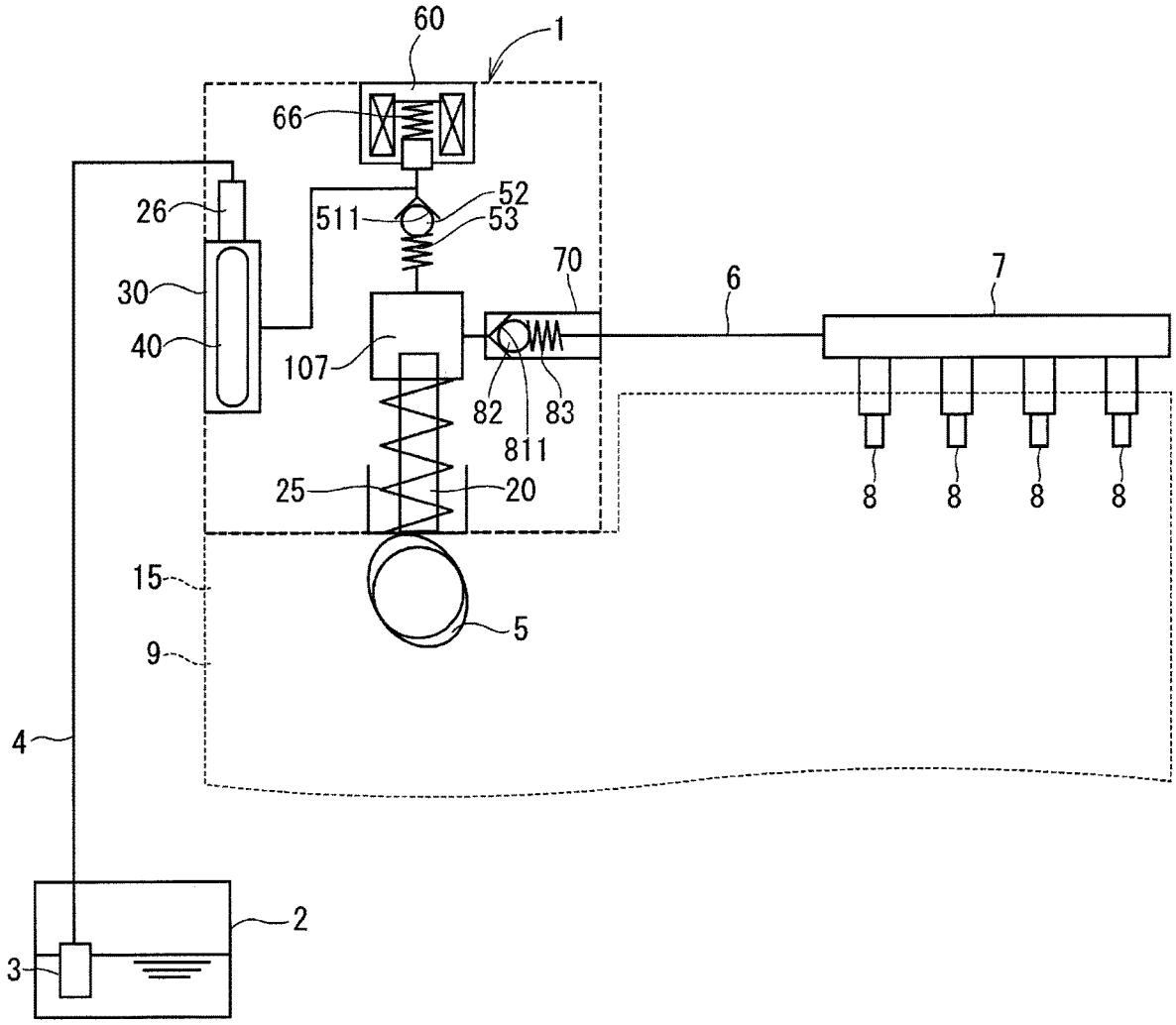
FIG. 1 is a schematic diagram showing a high pressure pump and a system having the high pressure pump according to a first embodiment of the present disclosure.

As shown in FIG. 1, the fuel, which is stored in a fuel tank 2, is supplied from a fuel pump 3 to the high pressure pump 1 through a pipe 4. The high pressure pump 1 pressurizes the fuel supplied from the fuel pump 3 and discharges the pressurized fuel to a fuel rail 7 through a pipe 6. Thereby, the fuel in the fuel rail 7 is accumulated under the pressurized state and is injected at the engine 9 from fuel injection valves 8 connected to the fuel rail 7.

As shown in FIGS. 2 and 3, the high pressure pump 1 includes a housing 10, a plunger 20, a fuel chamber forming portion 30, an inlet portion 26, a pulsation damper 40, a suction valve device 50, an electromagnetic drive device 60, a discharge portion 70 and a plurality of fixable portions 90.

The housing 10 is made of metal, such as stainless steel. The housing 10 includes a housing main body 11, a cylinder portion 12 and a holder support portion 13.

The housing main body 11 is shaped into a generally cylindrical form. The cylinder portion 12 is shaped into a generally cylindrical tubular form and is placed at a center of the housing main body 11. In the present embodiment, the cylinder portion 12 is formed integrally with the housing main body 11 in one piece.

The holder support portion 13 is shaped into a generally cylindrical tubular form and is placed on a radially outer side of one end of the cylinder portion 12 such that the holder support portion 13 is coaxial with the cylinder portion 12. In the present embodiment, the holder support portion 13 is formed integrally with the housing main body 11 in one piece.

The housing main body 11 includes an inflow hole 101, a plurality of holes 102, a plurality of holes 105, a suction hole 106, a discharge hole 109 and a hole 108.

On a radially outer side of the cylinder portion 12, the inflow hole 101 is radially inwardly recessed from an outer wall of the housing main body 11 and is shaped into a generally cylindrical form. Specifically, the inflow hole 101 is in the generally cylindrical form and is radially inwardly recessed from a peripheral wall of the housing main body 11, i.e., from a cylindrical outer wall of the housing main body 11.

Each of the holes 102 is formed to connect between the inflow hole 101 and a space formed between the cylinder portion 12 and the holder support portion 13. In the present embodiment, an axis of each of the holes 102 extends in parallel with an axis of the cylinder portion 12. Specifically, the number of the holes 102 is three, and each of these three holes 102 extends in parallel with the axis of the cylinder portion 12. Here, the expression of "parallel" should not be limited to a case where two straight lines are exactly parallel to each other but should include a case where the two straight lines are slightly non-parallel to each other. Hereinafter, this definition is equally applicable.

Each of the holes 105 is formed to connect the space, which is formed between the cylinder portion 12 and the holder support portion 13, to an end surface of the housing main body 11, which is opposite from the holder support portion 13. In the present embodiment, the number of the holes 105 is two, and the axis of each of these holes 105 is parallel to the axis of the cylinder portion 12.

The suction hole 106 is shaped into a generally cylindrical form and is recessed from the end surface of the housing main body 11, which is opposite from the holder support portion 13, in the axial direction of the cylinder portion 12. The suction hole 106 is connected to a space that is in an inside of the cylinder portion 12.

On the radially outer side of the cylinder portion 12, the discharge hole 109 is radially inward recessed from the outer wall of the housing main body 11 and is shaped into a generally cylindrical form. In the present embodiment, the discharge hole 109 is placed on an opposite side of the axis of the cylinder portion 12, which is diametrically opposite from the inflow hole 101.

The hole 108 is formed to connect between the space in the inside of the cylinder portion 12 and the discharge hole 109.

The plunger 20 is shaped into a generally cylindrical column form and is made of metal, such as stainless steel. The plunger 20 includes a large diameter portion 201 and a small diameter portion 202. An outer diameter of the small diameter portion 202 is smaller than an outer diameter of the large diameter portion 201. The large diameter portion 201 and the small diameter portion 202 are coaxial with each other. The plunger 20 is installed such that the large diameter portion 201 side of the plunger 20 is inserted into the inside of the cylinder portion 12. The outer diameter of the large diameter portion 201 of the plunger 20 is generally the same as an inner diameter of the cylinder portion 12 or is slightly smaller than the inner diameter of the cylinder portion 12. Thus, the plunger 20 is supported by the cylinder portion 12 in a manner that enables reciprocation of the plunger 20 in the axial direction while an outer wall of the large diameter portion 201 is slidable along an inner wall of the cylinder portion 12.

A pressurizing chamber 107 is formed between an inner wall of the cylinder portion 12 and an end part of the plunger 20, which is located on the large diameter portion 201 side. Specifically, the cylinder portion 12 has the pressurizing chamber 107 in the inside of the cylinder portion 12. A volume of the pressurizing chamber 107 changes when the plunger 20 reciprocates in the inside of the cylinder portion 12. The pressurizing chamber 107 is connected to the suction hole 106 and the hole 108.

In the present embodiment, a seal holder 21 is placed in an inside of the holder support portion 13. The seal holder 21 is shaped into a tubular form and is made of metal, such as stainless steel. The seal holder 21 is installed such that an outer wall of the seal holder 21 is fitted to an inner wall of the holder support portion 13. Furthermore, the seal holder 21 forms a generally cylindrical clearance between an inner wall of an end part of the seal holder 21, which is opposite from the cylinder portion 12, and an outer wall of the small diameter portion 202 of the plunger 20. A seal 22, which is shaped into a ring form, is installed between the inner wall of the seal holder 21 and the outer wall of the small diameter portion 202 of the plunger 20. The seal 22 includes a radially inner side ring made of fluoropolymer and a radially outer side ring made of rubber. A thickness of a fuel oil film around the small diameter portion 202 of the plunger 20 is adjusted by the seal 22, so that leakage of the fuel toward the engine 9 is limited. Furthermore, an oil seal 23 is installed to an end part of the seal holder 21, which is opposite from the cylinder portion 12. A thickness of the oil film around the small diameter portion 202 of the plunger 20 is adjusted by the oil seal 23, so that intrusion of the oil into the inside of the high pressure pump 1 is limited.

A variable volume chamber 104, a volume of which changes at the time of reciprocation of the plunger 20, is formed between a stepped surface, which is located between the large diameter portion 201 and the small diameter portion 202 of the plunger 20, and the seal 22.

Here, an annular space 103, which is a space in an annular form, is formed by the housing main body 11, the outer wall of the cylinder portion 12, the inner wall of the holder support portion 13, and the seal holder 21. The annular space 103 is connected to the inflow hole 101 through the holes 102. The annular space 103 is connected to the end surface of the housing main body 11, which is opposite from the holder support portion 13, through the holes 105. The annular space 103 is connected to the variable volume chamber 104 through a cylindrical space that is formed between the inner wall of the seal holder 21 and the outer wall of the cylinder portion 12.

A spring seat 24, which is shaped into a generally circular plate form, is placed at an end part of the small diameter portion 202 of the plunger 20, which is opposite from the large diameter portion 201. A spring 25 is installed between the seal holder 21 and the spring seat 24. The spring 25 is a coil spring. One end of the spring 25 contacts the spring seat 24, and the other end of the spring 25 contacts the seal holder 21. The spring 25 urges the plunger 20 toward an opposite side, which is opposite from the pressurizing chamber 107, through the spring seat 24.

The high pressure pump 1 is installed to an engine head 15 of the engine 9 such that an end part of the small diameter portion 202 of the plunger 20, which is opposite from the large diameter portion 201, contacts a cam 5 of a camshaft, which is rotated synchronously with a drive shaft of the engine 9. Thereby, the plunger 20 is reciprocated in the axial direction through the rotation of the cam 5 when the engine 9 is rotated. At this time, a volume of the pressurizing chamber 107 and a volume of the variable volume chamber 104 are periodically changed.

The fuel chamber forming portion 30 includes a plate portion 31, a tubular portion 32, a plate portion 33, a tubular portion 34 and a support member 35.

The plate portion 31, the tubular portion 32, the plate portion 33, the tubular portion 34 and the support member 35 are made of metal, such as stainless steel.

The plate portion 31 is shaped into a generally circular plate form. The tubular portion 32 is formed integrally with the plate portion 31 in one piece such that the tubular portion 32 is shaped into a generally cylindrical tubular form and extends from an outer periphery of the plate portion 31. The plate portion 33 is shaped into a generally circular plate form and closes an end part of the tubular portion 32, which is opposite from the plate portion 31. In this way, a fuel chamber 300, which is a planar circular space, is formed by the plate portion 31, the tubular portion 32 and the plate portion 33. Specifically, the fuel chamber forming portion 30 is shaped into a hollow circular disk form. The plate portion 33 is formed separately from the tubular portion 32.

The tubular portion 34 is formed integrally with the plate portion 33 in one piece such that the tubular portion 34 is shaped into a generally cylindrical tubular form and extends from a center of the plate portion 33 toward an opposite side that is opposite from the plate portion 31. In this way, an inside of the fuel chamber forming portion 30, i.e., the fuel chamber 300 is connected to an outside through a space in an inside of the tubular portion 34.

The support member 35 is placed in the fuel chamber 300.

The fuel chamber forming portion 30 is installed to the housing 10 such that the tubular portion 34 is fitted to the inflow hole 101 of the housing main body 11. In this way, the fuel chamber 300 is connected to the inflow hole 101 through the tubular portion 34.

The fuel chamber forming portion 30 is fixed to the housing main body 11 by, for example, welding.

The fuel chamber forming portion 30 is installed such that on the radially outer side of the plunger 20, at least a portion of the fuel chamber forming portion 30 is placed on an outer side of the peripheral wall of the housing main body 11 of the housing 10 (see FIGS. 2 and 3). Furthermore, the fuel chamber forming portion 30 is formed such that an axis Ax2 of the fuel chamber forming portion 30 is perpendicular to an axis Ax1 of the plunger 20 (see FIGS. 2 and 3). Here, the expression of "perpendicular" should not be limited to a case where two straight lines are exactly perpendicular to each other but should include a case where the two straight lines intersect with each other while the two straight lines are slightly tilted from the perpendicular as well as a case where the two straight lines are slightly spaced from each other. Hereinafter, this definition is equally applicable.

The inlet portion 26 is shaped into a generally cylindrical tubular form and is made of metal, such as stainless steel. In the present embodiment, the inlet portion 26 is connected to the tubular portion 32 of the fuel chamber forming portion 30 such that the axis of the inlet portion 26 is parallel to the axis Ax1 of the plunger 20. In this way, the inside of the fuel chamber forming portion 30, i.e., the fuel chamber 300 is connected to the outside through the space in the inside of the inlet portion 26. The pipe 4 is connected to the inlet portion 26. In this way, the fuel, which is discharged from the fuel pump 3, flows into the fuel chamber 300 through the inlet portion 26.

In the case where the inlet portion 26 is connected to the tubular portion 32, a direction of the axis of the inlet portion 26 can be freely set around the fuel chamber forming portion 30, so that a degree of freedom with respect to the installation of the high pressure pump 1 is improved.

The pulsation damper 40 is placed in the fuel chamber 300. The pulsation damper 40 is formed into a hollow circular disk form by joining outer peripheral edge parts of two diaphragms together, and gas of a predetermined pressure is sealed in the inside of the pulsation damper 40. The pulsation damper 40 is supported by the support member 35 in the fuel chamber 300. Here, the pulsation damper 40 is placed such that the axis Ax3 of the pulsation damper 40 is perpendicular to the axis Ax1 of the plunger 20 (see FIGS. 2 and 3). Specifically, in the present embodiment, the axis Ax2 of the fuel chamber forming portion 30 and the axis Ax3 of the pulsation damper 40 substantially coincide with each other.

The pulsation damper 40 can be resiliently deformed in response to a change in the fuel pressure in the fuel chamber 300 to reduce the pressure pulsation of the fuel.

In the present embodiment, the vibration limiting member 41 is placed in the inside of the pulsation damper 40. The vibration limiting member 41 is formed into a generally circular ring form and is made of a resilient member, such as rubber. An outer periphery of the vibration limiting member 41 contacts an inner wall of the pulsation damper 40. The vibration limiting member 41 can limit vibrations, which are generated when the pulsation damper 40 limits the pressure pulsation of the fuel.

A suction valve device 50 is installed in the suction hole 106 of the housing main body 11. The suction valve device 50 includes a suction valve seat portion 51, a suction valve 52, a spring 53, a stopper 54 and a screwing portion 55. Here, the suction hole 106, in which the suction valve device 50 is installed, is defined as a suction passage 500.

The suction valve seat portion 51 is shaped into a generally circular plate form and is made of metal, such as stainless steel. The suction valve seat portion 51 is installed in the suction passage 500. The suction valve seat portion 51 includes a plurality of holes, each of which connects between one end surface and another end surface of the suction valve seat portion 51. Furthermore, a suction valve seat 511 is formed around the holes at the end surface of the suction valve seat portion 51 located on the pressurizing chamber 107 side.

The suction valve 52 is shaped into a generally circular plate form and is made of metal, such as stainless steel.

The stopper 54 is shaped into a generally circular plate form and is made of metal, such as stainless steel. The stopper 54 is placed on the pressurizing chamber 107 side of the suction valve 52 such that an outer periphery of the stopper 54 is fitted to an inner wall of the suction hole 106. Here, an outer periphery of one surface of the stopper 54, which is located on the pressurizing chamber 107 side, contacts an end surface of the cylinder portion 12, which is opposite from the seal holder 21. Furthermore, an outer periphery of another surface of the stopper 54, which is opposite from the pressurizing chamber 107, contacts an outer periphery of the suction valve seat portion 51. The stopper 54 includes a plurality of holes, each of which communicates between the one surface and the other surface of the stopper 54.

The suction valve 52 is placed between the suction valve seat portion 51 and the stopper 54 in a manner that enables reciprocation of the suction valve 52. One end surface of the suction valve 52 is contactable with the suction valve seat 511. The suction valve 52 can open or close the suction passage 500 when the suction valve 52 is moved away from the suction valve seat 511 or contacts the suction valve seat 511. Specifically, the suction valve 52 can open and close the communication between the fuel chamber 300 and the pressurizing chamber 107.

The other end surface of the suction valve 52 is contactable with the stopper 54. The stopper 54 can limit the movement of the suction valve 52 toward the pressurizing chamber 107 when the suction valve 52 contacts the stopper 54.

The screwing portion 55 is shaped into a generally cylindrical tubular form and is made of metal, such as stainless steel. A male thread is formed at an outer wall of the screwing portion 55. A female thread, which corresponds to the male thread of the screwing portion 55, is formed at an inner wall of the suction hole 106. The screwing portion 55 is formed such that the screwing portion 55 is threadably engaged with the female screw of the suction hole 106. In this way, the screwing portion 55 urges the stopper 54 against the end surface of the cylinder portion 12, which is opposite from the seal holder 21, through the suction valve seat portion 51. Specifically, the suction valve seat portion 51 and the stopper 54 are fixed such that the suction valve seat portion 51 and the stopper 54 are clamped between the screwing portion 55 and the cylinder portion 12.

The screwing portion 55 is coaxial with the axis (the axis Ax1) of the plunger 20. Therefore, it is possible to reduce the influence of distortion, which is caused by the screwing of the screwing portion 55, on the slidable portion of the plunger 20.

The spring 53 is, for example, a coil spring and is placed between the suction valve 52 and the stopper 54. The spring 53 urges the suction valve 52 toward the suction valve seat 511.

The electromagnetic drive device 60 is placed on an opposite side of the suction valve device 50, which is opposite from the plunger 20. The electromagnetic drive device 60 includes a yoke 61, a needle 62, a movable core 63, a tubular member 64, a stationary core 65, a spring 66, a coil 67, a yoke 68 and a connector 69.

The yoke 61 is shaped into a generally circular plate form and is made of, for example, a magnetic material. The yoke 61 is fixed to the housing main body 11 in a state where a gap s1 is formed between the yoke 61 and the end surface of the housing main body 11, which is opposite from the holder support portion 13. In this way, the holes 105 and the suction passage 500 are connected with each other through the gap s1.

The needle 62 is shaped into a rod form and is made of, for example, metal. The needle 62 is supported by a hole, which is formed at a center of the yoke 61, in a manner that enables reciprocation of the needle 62. One end part of the needle 62 is inserted through a hole, which is formed at a center of the suction valve seat portion 51, such that the one end part of the needle 62 is contactable with the end surface of the suction valve 52, which is opposite from the pressurizing chamber 107. In the present embodiment, the needle 62 is coaxial with the plunger 20.

The movable core 63 is shaped into a generally cylindrical tubular form and is made of, for example, a magnetic material. The movable core 63 is installed to another end part of the needle 62.

The tubular member 64 is shaped into a tubular form and is made of, for example, a non-magnetic material. On a radially outer side of the movable core 63, the tubular member 64 is placed on an opposite side of the yoke 61, which is opposite from the suction valve device 50.

The stationary core 65 is made of, for example, a magnetic material and is placed on an opposite side of the tubular member 64, which is opposite from the yoke 61.

The spring 66 is, for example, a coil spring and is placed between the needle 62 and the stationary core 65. The spring 66 urges the needle 62 toward the pressurizing chamber 107. Here, an urging force of the spring 66 is set to be larger than an urging force of the spring 53. Therefore, the suction valve 52 is spaced from the suction valve seat 511.

The coil 67 is shaped into a generally cylindrical tubular form and is placed on a radially outer side of the tubular member 64 and the stationary core 65.

The yoke 68 is shaped into a bottomed tubular form and is made of, for example, a magnetic material. The yoke 68 is placed such that the yoke 68 covers the coil 67, and an opening of the yoke 68 contacts the yoke 61.

The connector 69 is formed to extend toward a radially outer side of the yoke 68. The connector 69 includes terminals 691. Each terminal 691 is shaped into a rod form and is made of an electrically conductive material such that one end of the terminal 691 is electrically connected to the coil 67. A harness 692 is connected to the connector 69. Thereby, an electric power is supplied to the coil 67 through the harness 692 and the terminals 691.

When the coil 67 is energized, a magnetic circuit is formed at the yoke 61, the yoke 68, the stationary core 65 and the movable core 63. In this way, the movable core 63 is magnetically attracted together with the needle 62 toward the stationary core 65. Thereby, the suction valve 52 is moved by the urging force of the spring 53 toward the suction valve seat 511 and contacts the suction valve seat 511, so that the suction valve 52 is placed into a valve closing state thereof.

When the energization of the coil 67 is stopped, the movable core 63 is urged together with the needle 62 by the urging force of the spring 66 toward the pressurizing chamber 107. Thus, the suction valve 52 is urged by the needle 62 toward the pressurizing chamber 107, so that the suction valve 52 is moved away from the suction valve seat 511 and is placed into a valve opening state thereof.

As discussed above, when the electromagnetic drive device 60 is energized, the electromagnetic drive device 60 drives the suction valve device 50 to open or close the suction passage 500 formed between the pressurizing chamber 107 and the fuel chamber 300. In the present embodiment, the electromagnetic drive device 60 functions as a normally open type valve device in such a way that the electromagnetic drive device 60 places the suction valve 52 into the valve opening state at the time of stopping the energization of the electromagnetic drive device 60 and places the suction valve 52 into the valve closing state at the time of energization of the electromagnetic drive device 60.

The discharge portion 70 is placed at the discharge hole 109 of the housing main body 11. The discharge portion 70 includes a discharge tubular portion 71.

The discharge tubular portion 71 is shaped into a generally cylindrical tubular form and is made of metal, such as stainless steel. The discharge tubular portion 71 is installed to the housing main body 11 such that one end part of the discharge tubular portion 71 is threadably engaged with an inner wall of the discharge hole 109. A discharge passage 700 is formed in an inside of the discharge tubular portion 71. The pipe 6 is connected to another end part of the discharge tubular portion 71.

A discharge valve device 80 is installed in the discharge passage 700. The discharge valve device 80 includes a discharge valve seat portion 81, a discharge valve 82 and a spring 83.

The discharge valve seat portion 81 is shaped into a bottomed tubular form and is made of metal, such as stainless steel. The discharge valve seat portion 81 includes a hole at a bottom part of the discharge valve seat portion 81. A discharge valve seat 811 is formed around the hole at an opposite surface of the bottom part of the discharge valve seat portion 81, which is opposite from the pressurizing chamber 107.

The discharge valve 82 is shaped into a generally circular plate form and is made of metal, such as stainless steel. The discharge valve 82 is placed on an opposite side of the discharge valve seat 811, which is opposite from the pressurizing chamber 107, in a manner that enables reciprocation of the discharge valve 82. One end surface of the discharge valve 82 is contactable with the discharge valve seat 811. The discharge valve 82 can open or close the discharge passage 700 when the discharge valve 82 is moved away from the discharge valve seat 811 or contacts the discharge valve seat 811. Specifically, the discharge valve 82 can open or close a connection between the pressurizing chamber 107 and the pipe 6.

The spring 83 is, for example, a coil spring and urges the discharge valve 82 toward the discharge valve seat 811.

The discharge valve 82 is moved away from the discharge valve seat 811 and is thereby placed into a valve opening state when a pressure of the fuel in a space located on the pressurizing chamber 107 side of the discharge valve seat portion 81 becomes larger than a sum (a valve opening pressure of the discharge valve 82) of the urging force of the spring 83 and a pressure of the fuel in a space on an opposite side (i.e., a pipe 6 side) of the discharge valve seat portion 81 that is opposite from the pressurizing chamber 107. Thereby, the fuel on the pressurizing chamber 107 side of the discharge valve seat portion 81 is discharged toward the pipe 6 through the discharge valve seat portion 81. The valve opening pressure of the discharge valve 82 can be set by adjusting the urging force of the spring 83.

The fixable portions 90 are formed at the outer wall of the housing main body 11 on the radially outer side of the plunger 20. Specifically, the fixable portions 90 are provided at the peripheral wall of the housing main body 11. In the present embodiment, the fixable portions 90 are made of metal, such as stainless steel. The fixable portions 90 are formed integrally with the housing main body 11 in one piece such that the fixable portions 90 project from the peripheral wall of the housing main body 11 toward the radially outer side of the plunger 20. The fixable portions 90 are symmetrical to each other with respect to the axis Ax1 of the plunger 20 that serves as an axis of symmetry. Specifically, the number of the fixable portions 90 is two, and these two fixable portions 90 are symmetrical to each other with respect to the axis Ax1 of the plunger 20 that serves as the axis of symmetry. That is, the two fixable portions 90 are formed at the outer wall of the housing main body 11 such that the axis Ax1 of the plunger 20 is interposed between the fixable portions 90. In other words, the fixable portions 90 are arranged at equal intervals (180 degree intervals) in the circumferential direction.

Each of the two fixable portions 90 includes a receiving through-hole 900. The receiving through-hole 900 is formed such that an axis Ax4 of the receiving through-hole 900 is in parallel with the axis Ax1 of the plunger 20.

In the present embodiment, each of the fixable portions 90 is fixed to the engine head 15 by a bolt 91 that is a fixing member provided to correspond with the receiving through-hole 900.

The bolt 91, which serves as the fixing member, includes a shaft portion 911 and a head portion 912. The shaft portion 911 is shaped into a generally cylindrical column form, and a male thread is formed at one end part of the shaft portion 911. The head portion 912 is shaped into, for example, a hexagonal prism form and is formed at another end part of the shaft portion 911.

A plurality of fixation holes 151 is formed at the engine head 15. The fixation hole 151 is formed such that an axis of the fixation hole 151 is generally parallel to an axis of an installation hole portion 150. A female thread, which corresponds to the male thread of the shaft portion 911 of the bolt 91, is formed at an inner wall of each fixation hole 151.

Figure 4:
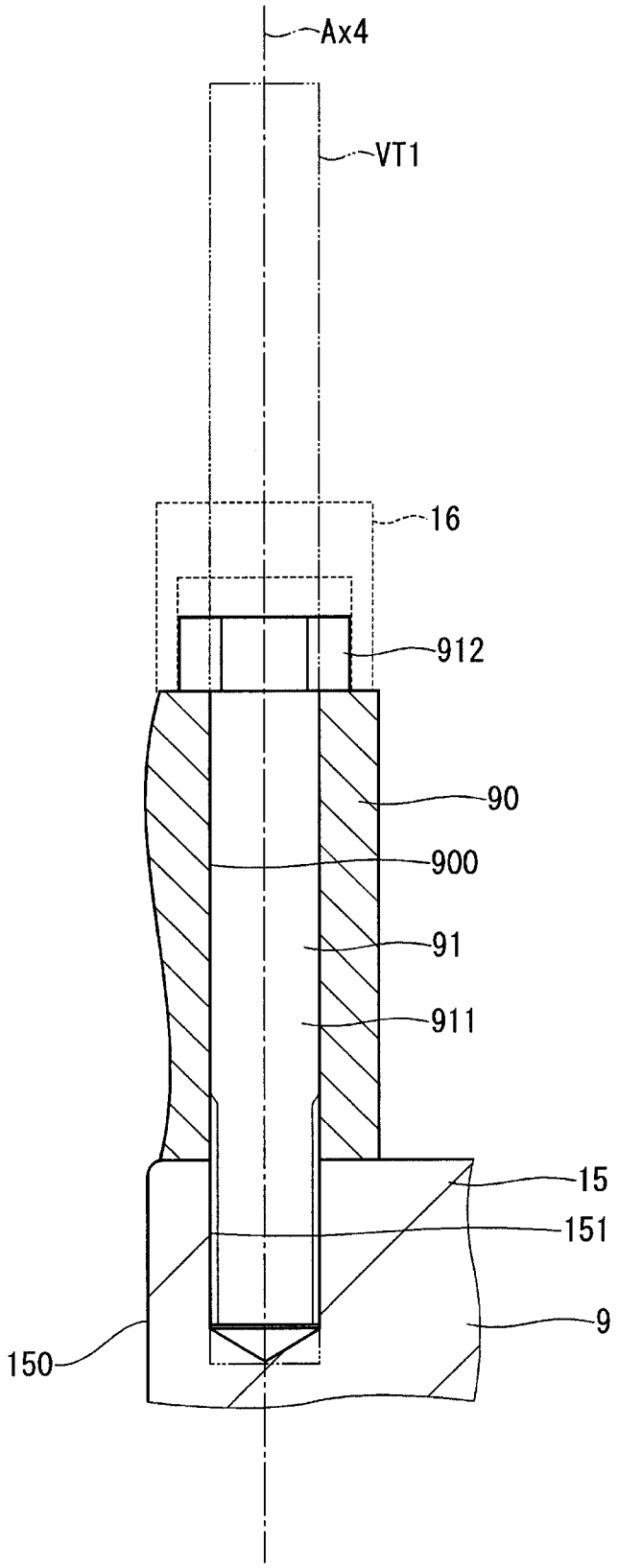
FIG. 4 is a cross-sectional view showing a receiving through-hole of the high pressure pump and its adjacent area according to the first embodiment of the present disclosure.

The bolt 91 is inserted through the receiving through-hole 900 of the fixable portion 90 such that the one end part of the shaft portion 911 is threaded into the fixation hole 151 of the engine head 15, and thereby the bolt 91 is fixed such that the fixable portion 90 is clamped between the head portion 912 and the engine head 15 (see FIG. 4). In this way, the high pressure pump 1 can be fixed to the engine 9.

Figure 5:
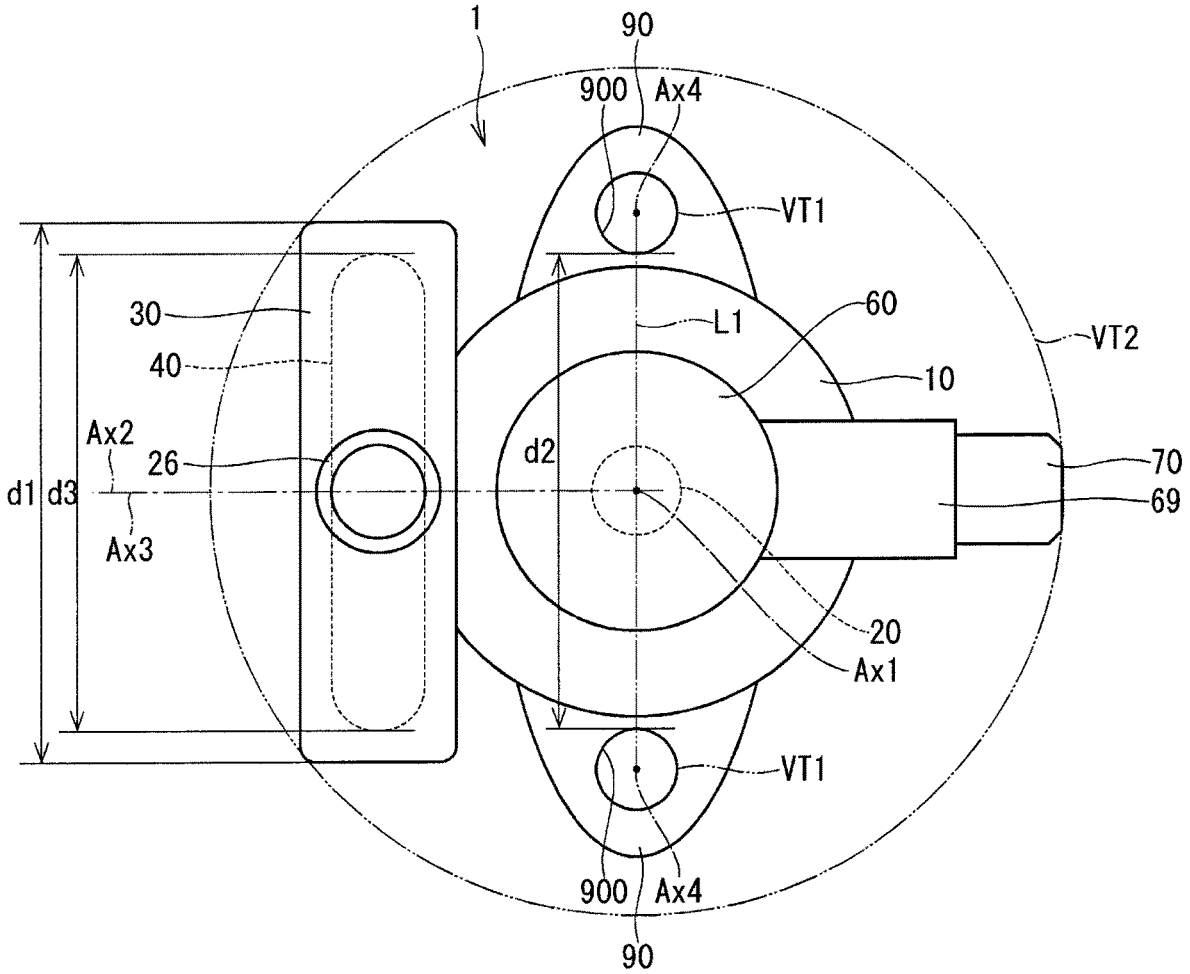
FIG. 5 is a schematic diagram showing the high pressure pump according to the first embodiment of the present disclosure.

As shown in FIGS. 3 and 5, in the present embodiment, the fuel chamber forming portion 30 is placed at a location that is radially outwardly displaced from the axes Ax4 of the receiving through-holes 900 and imaginary tubular surfaces VT1 in the radial direction of the plunger 20 while each of the imaginary tubular surfaces VT1 is defined to include all of the inner wall of the corresponding receiving through-hole 900. That is, each axis Ax4 and each imaginary tubular surface VT1 do not extend through the fuel chamber forming portion 30 and the pulsation damper 40, and the fuel chamber forming portion 30 is spaced from the axis Ax4 and the imaginary tubular surface VT1 by a predetermined distance or more.

The fuel chamber forming portion 30 is placed at the location that is displaced from a straight line L1, which connects between the axes Ax4 of the two receiving through-holes 900. Specifically, the fuel chamber forming portion 30 and the pulsation damper 40 are not located between the two receiving through-holes 900. The straight line L1 extends through the axis Ax1 of the plunger 20.

An outer diameter d1 of the fuel chamber forming portion 30 is larger than a distance d2 between the two receiving through-holes 900. An outer diameter d3 of the pulsation damper 40 is slightly smaller than the distance d2 between the two receiving through-holes 900.

Furthermore, as shown in FIG. 5, the electromagnetic drive device 60 is placed at a location that is along the axis Ax1 of the plunger 20 and is displaced from the axes Ax4 and the imaginary tubular surfaces VT1. The needle 62, the movable core 63, the stationary core 65 and the coil 67 of the electromagnetic drive device 60 are placed such that the axis of these respective components substantially coincide with the axis Ax1 of the plunger 20 (see FIG. 2).

The connector 69 and the discharge portion 70 are placed to face in a common direction. The inlet portion 26, the discharge portion 70 and the connector 69 are respectively placed at corresponding locations that are displaced from the axes Ax4 and the imaginary tubular surfaces VT1. The fuel chamber forming portion 30, the fixable portions 90, the electromagnetic drive device 60, the inlet portion 26 and the discharge portion 70 are placed on an inner side of an imaginary cylindrical surface VT2 that circumferentially extends about the axis Ax1 of the plunger 20 along an end part of the discharge portion 70.

Furthermore, in the present embodiment, the suction valve device 50 and the electromagnetic drive device 60 are placed along the axis of the plunger 20, and the suction valve 52 is placed as close as possible to the pressurizing chamber 107. Thereby, a dead volume connected to the pressurizing chamber 107 can be made relatively small. Thereby, the fuel can be effectively pressurized.

Furthermore, even when the plunger 20 is placed at the top-dead center side, the flow passage between the pressurizing chamber 107 and the suction valve 52 is not closed, so that the fuel can be effectively suctioned into and discharged from the pressurizing chamber 107.

Next, the installation method of the high pressure pump 1 to the engine 9 according to the present embodiment will be described.

First of all, as shown in FIG. 2, the holder support portion 13 of the housing 10 is inserted into the installation hole portion 150. At this time, the receiving through-hole 900 of each fixable portion 90 is aligned with the corresponding fixation hole 151 of the engine head 15 (see FIG. 4). Next, each of the bolts 91 is inserted through the corresponding one of the receiving through-holes 900 and is threadably tightened into the corresponding fixation hole 151 with a tool 16. In this way, the fixable portions 90 are fixed to the engine head 15, and thereby the installation of the high pressure pump 1 to the engine 9 is completed. In the present embodiment, the fuel chamber forming portion 30, the inlet portion 26, the discharge portion 70 and the connector 69 are respectively placed at the corresponding locations that are displaced from the axes Ax4 and the imaginary tubular surfaces VT1, so that the tool 16 does not interfere with the fuel chamber forming portion 30, the inlet portion 26, the discharge portion 70 and the connector 69, and thereby the bolts 91 can be easily tightened with the tool 16.

Next, the operation of the high pressure pump 1 will be described with reference to FIG. 2.

(Suction Stroke)

When the supply of the electric power to the coil 67 of the electromagnetic drive device 60 is stopped, the suction valve 52 is urged toward the pressurizing chamber 107 by the spring 66 and the needle 62. Therefore, the suction valve 52 is lifted away from the suction valve seat 511, i.e., is placed into a valve opening state. In this state, when the plunger 20 is moved toward the cam 5, a volume of the pressurizing chamber 107 is increased, so that the fuel in the suction passage 500, which is located on an opposite side of the suction valve seat 511 that is opposite from the pressurizing chamber 107, is suctioned into the pressurizing chamber 107.

In the suction stroke, the fuel of the fuel chamber 300 can flow into the inflow hole 101, and the fuel of the inflow hole 101 can flow into the hole 102. Also, the fuel of the hole 102 can flow into the annular space 103, and the fuel of the annular space 103 can flow into the holes 105. Furthermore, the fuel of the holes 105 can flow into the gap s1, and the fuel of the gap s1 can flow into the suction passage 500. Additionally, the fuel of the suction passage 500 can flow into the pressurizing chamber 107.

(Metering Stroke)

In the state where the suction valve 52 is placed into the valve opening state, when the plunger 20 is moved toward the opposite side, which is opposite from the cam 5, the volume of the pressurizing chamber 107 is reduced. Thereby, the fuel in the pressurizing chamber 107 is returned toward the opposite side of the suction valve seat 511, which is opposite from the pressurizing chamber 107, in the suction passage 500. When the electric power is supplied to the coil 67 in the middle of the metering stroke, the movable core 63 is magnetically attracted together with the needle 62 toward the stationary core 65. Thereby, the suction valve 52 contacts the suction valve seat 511 and is thereby closed. At the time of moving the plunger 20 toward the opposite side that is opposite from the cam 5, by adjusting the valve closing timing of the suction valve 52, the amount of fuel returned from the pressurizing chamber 107 to the suction passage 500 is adjusted. Thereby, the amount of fuel, which is pressurized in the pressurizing chamber 107, is determined. When the suction valve 52 is closed, the metering stroke, which returns the fuel from the pressurizing chamber 107 to the suction passage 500, ends.

In the metering stroke, the fuel in the pressurizing chamber 107 can outflow to the suction passage 500, and the fuel in the suction passage 500 can outflow to the gap s1. Also, the fuel in the gap s1 can outflow to the holes 105. Furthermore, the fuel in the holes 105 can outflow to the annular space 103, and the fuel in the annular space 103 can outflow to the hole 102. Additionally, the fuel in the hole 102 can outflow to the inflow hole 101, and the fuel in the inflow hole 101 can outflow to the fuel chamber 300.

(Pressurizing Stroke)

When the plunger 20 is moved to the opposite side, which is opposite from the cam 5, in the valve closing state of the suction valve 52, the volume of the pressurizing chamber 107 is reduced, and the fuel in the pressurizing chamber 107 is compressed and is pressurized. When the pressure of the fuel in the pressurizing chamber 107 becomes equal to or larger than the valve opening pressure of the discharge valve 82, the discharge valve 82 is opened. Thereby, the fuel is discharged from the pressurizing chamber 107 to the pipe 6 side, i.e., to the fuel rail 7 side.

When the plunger 20 is moved toward the cam 5 after stopping of the supply of the electric power to the coil 67, the suction valve 52 opens once again. In this way, the pressurizing stroke, which pressurizes the fuel, ends, and the suction stroke, which suctions the fuel from the suction passage 500 into the pressurizing chamber 107, starts once again.

By repeating the suction stroke, the metering stroke and the pressurizing stroke, the high pressure pump 1 pressurizes the fuel suctioned from the fuel tank 2 and discharges the pressurized fuel to supply the fuel to the fuel rail 7. The amount of fuel supplied from the high pressure pump 1 to the fuel rail 7 is adjusted by controlling, for example, supply timing of the electric power to the coil 67 of the electromagnetic drive device 60.

When the plunger 20 is reciprocated in the valve opening state of the suction valve 52 in, for example, the suction stroke or the metering stroke, pressure pulsation may be generated in the fuel in the fuel chamber 300. The pulsation damper 40, which is placed in the fuel chamber 300, can be resiliently deformed in response to a change in the fuel pressure in the fuel chamber 300 to reduce the pressure pulsation of the fuel in the fuel chamber 300.

In the state where the discharging of the fuel from the high pressure pump 1 to the fuel rail 7 continues, the fuel, which is supplied from the inlet portion 26, flows to the pressurizing chamber 107 through the fuel chamber 300, the inflow hole 101, the hole 102, the annular space 103, the holes 105, the space between the housing main body 11 and the yoke 61 and the suction passage 500. Furthermore, when the plunger 20 is reciprocated, the volume of the variable volume chamber 104 is increased and is then decreased, and so on. Therefore, the fuel flows back and forth between the annular space 103 and the variable volume chamber 104. Thereby, the cylinder portion 12 and the plunger 20, which have become high temperature due to the heat generated by the sliding between the plunger 20 and the cylinder portion 12 and the heat generated by the pressurization of the fuel in the pressurizing chamber 107, can be cooled by the low temperature fuel. Thereby, it is possible to limit seizure of the plunger 20 and the cylinder portion 12.

Furthermore, a portion of the fuel, which becomes the high temperature in the pressurizing chamber 107, flows into the variable volume chamber 104 through the clearance between the plunger 20 and the cylinder portion 12. Thereby, an oil film is formed between the plunger 20 and the cylinder portion 12, so that it is possible to limit the seizure of the plunger 20 and the cylinder portion 12. The fuel, which flows from the pressurizing chamber 107 into the variable volume chamber 104, flows into the pressurizing chamber 107 through the annular space 103, the holes 105 and the suction passage 500 once again.

As discussed above, (1) in the present embodiment, the high pressure pump 1 is installed to the engine 9 to pressurize, discharge and supply the fuel to the engine 9 and includes the housing 10, the plunger 20, the fuel chamber forming portion 30, the pulsation damper 40, the discharge portion 70 and the fixable portions 90.

The housing 10 includes a pressurizing chamber 107.

The plunger 20 is moved to increase and decrease the volume of the pressurizing chamber 107, so that the plunger 20 can pressurize the fuel in the pressurizing chamber 107.

The fuel chamber forming portion 30 is placed on the radially outer side of the plunger 20 and forms the fuel chamber 300 that is communicated with the pressurizing chamber 107.

The pulsation damper 40 is placed in the inside of the fuel chamber 300 and is operable to reduce the pressure pulsation of the fuel in the fuel chamber 300.

The discharge portion 70 discharges the fuel, which is pressurized in the pressurizing chamber 107.

The fixable portions 90 are formed at the outer wall of the housing main body 11 on the radially outer side of the plunger 20 while each of the fixable portions 90 includes the receiving through-hole 900, the axis Ax4 of which is parallel with the axis Ax1 of the plunger 20. The fixable portions 90 are fixed to the engine 9 with the bolts 91, which are provided to correspond with the receiving through-holes 900, respectively.

In the present embodiment, the fuel chamber forming portion 30 is placed at the location that is displaced from the axes Ax4 of the receiving through-holes 900. Thus, it is possible to limit the interference of the tool 16, which is used to fix the fixable portions 90 of the high pressure pump 1 to the engine 9 with the bolts 91, relative to the fuel chamber forming portion 30. In this way, the installation of the high pressure pump 1 to the engine 9 is eased.

Furthermore, in the present embodiment, the fuel chamber forming portion 30 is located on the radially outer side of the plunger 20, so that the size of the fuel chamber forming portion 30 can be increased while avoiding the axis Ax4 of each receiving through-hole 900. Therefore, the size of the pulsation damper 40 can be increased while limiting the interference between the tool 16 and the fuel chamber forming portion 30 at the time of fixing the fixable portion 90 with the bolts 91. Thereby, it is possible to provide the good pressure pulsation reducing effect for reducing the pressure pulsation of the fuel in the fuel chamber 300.

Also, in the present embodiment, the fuel chamber forming portion 30 is placed at the location that is radially outwardly displaced from the axes Ax4 of the receiving through-holes 900 in the radial direction of the plunger 20. Therefore, each of the receiving through-holes 900 can be placed at the corresponding location that is close to the axis Ax1 of the plunger 20. Therefore, it is possible to reduce the size of the high pressure pump 1 that includes the fixable portions 90, in each of which the receiving through-hole 900 is formed.

Furthermore, (2) in the present embodiment, the fuel chamber forming portion 30 is placed at the location that is displaced from the imaginary tubular surfaces VT1, each of which includes all of the inner wall of the corresponding receiving through-hole 900. Therefore, it is possible to further effectively limit the interference of the tool 16, which is used to fix the fixable portions 90 of the high pressure pump 1 to the engine 9 with the bolts 91, relative to the fuel chamber forming portion 30.

Furthermore, (3) in the present embodiment, the bolts 91 are respectively inserted into the receiving through-holes 900 and are fixed to the engine 9, so that the bolts 91 fix the fixable portions 90 to the engine 9. This specifically exemplifies the construction of the fixing members that are used at the time of fixing the fixable portions 90 to the engine 9.

Furthermore, (4) in the present embodiment, the pulsation damper 40 is in a hollow circular disk form and is configured such that the axis Ax3 of the pulsation damper 40 intersects with the axis Ax1 of the plunger 20.

Furthermore, the pulsation damper 40 is placed such that the axis Ax3 of the pulsation damper 40 is perpendicular to the axis Ax1 of the plunger 20. This specifically exemplifies the shape and the position of the pulsation damper 40. By setting the shape and the position of the pulsation damper 40 in the above described manner, the fuel chamber forming portion 30 can be displaced from the axis Ax4 of each receiving through-hole 900, and the size of the fuel chamber forming portion 30 and the size of the pulsation damper 40 can be easily increased.

Furthermore, (6) in the present embodiment, the two receiving through-holes 900 are formed to be symmetrical to each other with respect to the axis Ax1 of the plunger 20, which serves as the axis of symmetry. In the present embodiment, the fuel chamber forming portion 30 is placed at the location that is displaced from the axes Ax4 of the receiving through-holes 900. Therefore, even though the two receiving through-holes 900 are arranged symmetrical to each other with respect to the axis Ax1 of the plunger 20, it is possible to increase the size of the fuel chamber 300 and the size of the pulsation damper 40 while limiting the interference of the tool 16, which is used to fix the fixable portions 90 of the high pressure pump 1 to the engine 9 with the bolts 91, relative to the fuel chamber forming portion 30.

Furthermore, (7) in the present embodiment, the fuel chamber forming portion 30 is shaped into a hollow circular disk form and has the outer diameter d1 that is larger than the distance d2 between the two receiving through-holes 900. Therefore, the size of the pulsation damper 40 can be increase while limiting an increase in the size of the high pressure pump 1 that includes the fixable portions 90, in each of which the receiving through-hole 900 is formed. Thereby, it is possible to provide the good pressure pulsation reducing effect for reducing the pressure pulsation of the fuel in the fuel chamber 300.

Furthermore, (8) in the present embodiment, there is also provided the inlet portion 26, which is shaped into the tubular form and is communicated with the fuel chamber 300 to guide the fuel from the outside to the fuel chamber 300. The inlet portion 26 is connected to the fuel chamber forming portion 30. This specifically exemplifies the construction of the present embodiment.

Furthermore, (10) in the present embodiment, the inlet portion 26 is placed at the location that is displaced from the axes Ax4 of the receiving through-holes 900 and the imaginary tubular surfaces VT1. Thus, it is possible to limit the interference of the tool 16, which is used to fix the fixable portions 90 of the high pressure pump 1 to the engine 9 with the bolts 91, relative to the inlet portion 26. In this way, the installation of the high pressure pump 1 to the engine 9 is eased.

In the present embodiment, the fuel chamber forming portion 30 is placed on the radially outer side of the plunger 20 such that the fuel chamber forming portion 30 is displaced from the axes Ax4 of the receiving through-holes 900. Therefore, the inlet portion 26 can be easily connected to the fuel chamber forming portion 30 such that the inlet portion 26 is displaced from the axes Ax4 of the receiving through-holes 900. Therefore, a degree of freedom is increased with respect to the connecting location and the connecting direction of the inlet portion 26 relative to the fuel chamber forming portion 30.

Furthermore, (12) in the present embodiment, there are further provided the suction valve device 50 and the electromagnetic drive device 60.

The suction valve device 50 can open and close the connection between the pressurizing chamber 107 and the fuel chamber 300.

When the electromagnetic drive device 60 is energized, the electromagnetic drive device 60 can drive the suction valve device 50 such that the suction valve device 50 opens and closes the connection between the pressurizing chamber 107 and the fuel chamber 300.

The electromagnetic drive device 60 is placed at the location that is displaced from the axes Ax4 of the receiving through-holes 900 and the imaginary tubular surfaces VT1. Thus, it is possible to limit the interference of the tool 16, which is used to fix the fixable portions 90 of the high pressure pump 1 to the engine 9 with the bolts 91, relative to the electromagnetic drive device 60. In this way, the installation of the high pressure pump 1 to the engine 9 is eased.

Furthermore, (13) in the present embodiment, the electromagnetic drive device 60 is placed along the axis Ax1 of the plunger 20. This specifically exemplifies the construction of the present embodiment.

Furthermore, (15) in the present embodiment, the electromagnetic drive device 60 includes the connector 69, to which the harness 692 used for the energization of the electromagnetic drive device 60 is connected.

The connector 69 is placed at the location that is displaced from the axes Ax4 of the receiving through-holes 900 and the imaginary tubular surfaces VT1. Thus, it is possible to limit the interference of the tool 16, which is used to fix the fixable portions 90 of the high pressure pump 1 to the engine 9 with the bolts 91, relative to the connector 69. In this way, the installation of the high pressure pump 1 to the engine 9 is eased.

Second Embodiment

Figure 6:
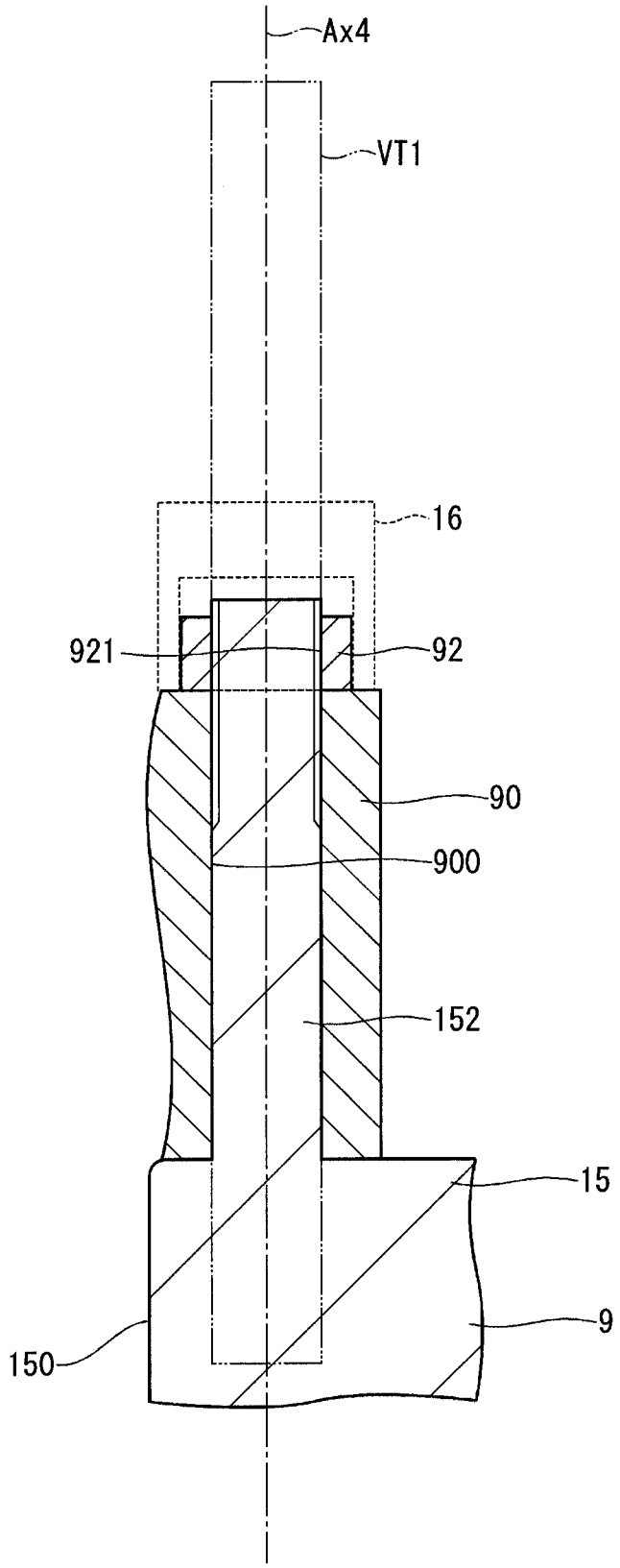
FIG. 6 is a cross-sectional view showing a receiving through-hole of the high pressure pump and its adjacent area according to a second embodiment of the present disclosure.

FIG. 6 shows a portion of the high pressure pump according to a second embodiment of the present disclosure. The second embodiment differs from the first embodiment with respect to the structure of fixing members that fix the fixable portions 90 to the engine 9.

In the second embodiment, shaft portions 152 are formed at the engine head 15 of the engine 9. The shaft portions 152 are formed integrally as one piece with the engine head 15 such that the shaft portions 152 respectively extend from the engine head 15 in a generally cylindrical column form. The shaft portion 152 is formed such that an axis of the shaft portion 152 is generally parallel to the axis of the installation hole portion 150. A male thread is formed at an outer wall of an opposite end part of each shaft portion 152, which is opposite from the engine head 15.

In the present embodiment, each of the fixable portions 90 is fixed to the engine head 15 by a nut 92, which is provided to correspond with the receiving through-hole 900 and serves as the fixing member. The nut 92 is shaped into a hexagonal prism form and has a hole 921 at a center of the nut 92. A female thread, which corresponds to the male thread of the shaft portion 152, is formed at an inner wall of the hole 921.

The nut 92 is threadably tightened along the shaft portion 152 inserted into the receiving through-hole 900 of the fixable portion 90, so that the fixable portion 90 can be securely clamped between the nut 92 and the engine head 15 (see FIG. 6). In this way, the high pressure pump can be fixed to the engine 9.

The rest of the second embodiment, which is other than the above described points, is the same as that of the first embodiment.

As discussed above, (3) in the present embodiment, the nuts 92, which serve as the fixing members, are respectively fixed to the shaft portions 152 that are the parts of the engine 9 and are respectively received through the receiving through-holes 900, so that the fixable portions 90 can be fixed to the engine 9. This specifically exemplifies the construction of the fixing members that are used at the time of fixing the fixable portions 90 to the engine 9.

Even in the second embodiment, various advantages can be achieved like in the first embodiment.

Third Embodiment

Figure 7:
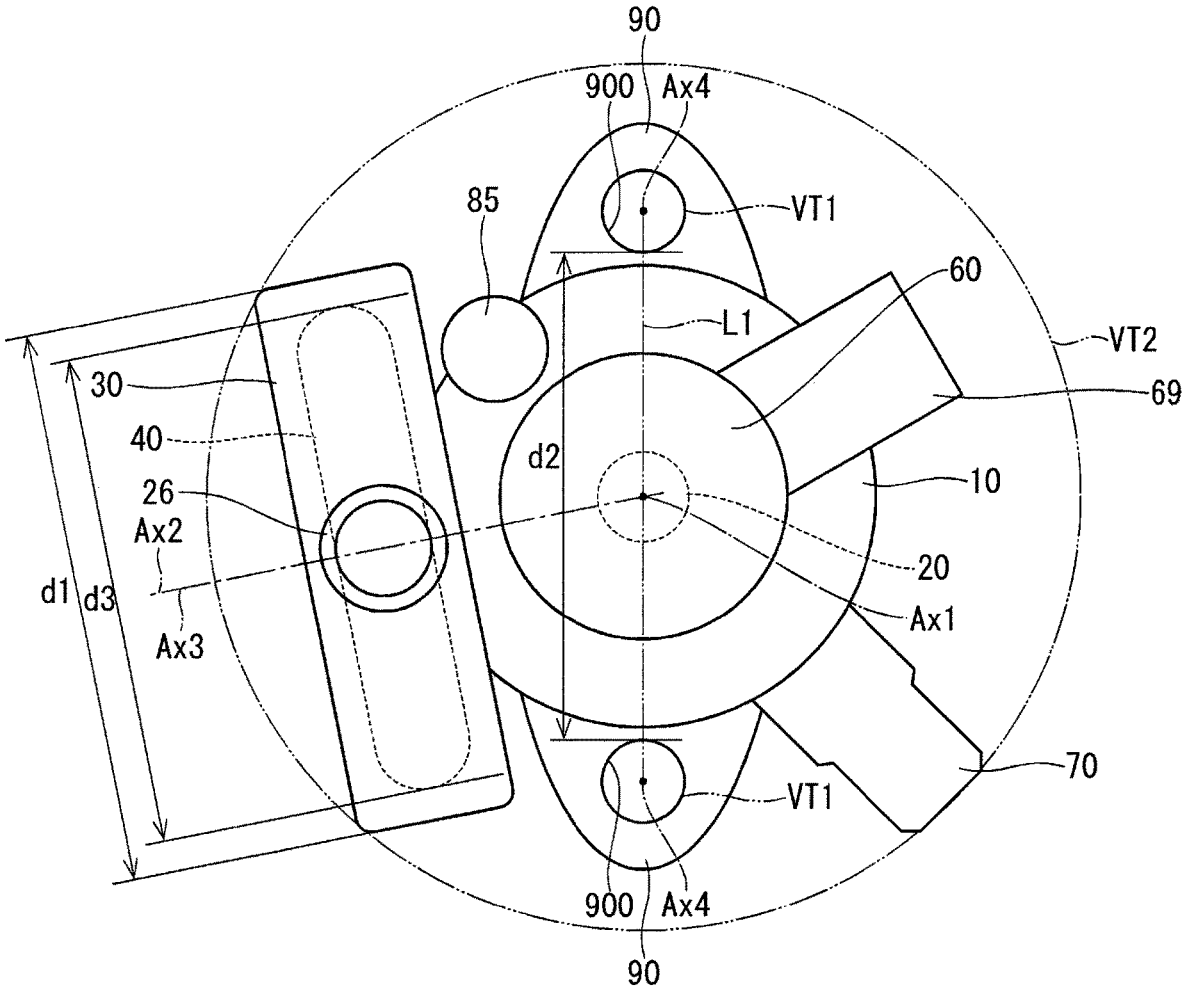
FIG. 7 is a schematic diagram showing a high pressure pump according to a third embodiment of the present disclosure.

FIG. 7 shows a high pressure pump according to a third embodiment of the present disclosure. A position of the fuel chamber forming portion 30 is different from that of the first embodiment.

In the third embodiment, there is further provided a relief valve device 85. The relief valve device 85 is installed to the outer wall of the housing main body 11 of the housing 10. In the present embodiment, the relief valve device 85 is placed to project form the outer wall of the housing main body 11 in a direction that is generally parallel to the axis Ax1 of the plunger 20. The relief valve device 85 includes, for example, a relief valve (not shown). The relief valve is placed such that the relief valve can open and close a passage that connects between an opposite side of the discharge valve seat 811, which is in the inside of the discharge tubular portion 71 of the discharge portion 70 and is opposite from the pressurizing chamber 107, and the gap s1 (see FIG. 2) between the housing main body 11 and the yoke 61. In the relief valve device 85, when the pressure of the fuel at the opposite side of the discharge valve seat 811, which is in the inside of the discharge tubular portion 71 of the discharge portion 70 and is opposite from the pressurizing chamber 107, becomes equal to or larger than a predetermined value, the relief valve is opened to release the fuel to the gap s1 between the housing main body 11 and the yoke 61. Therefore, it is possible to limit an excess increase of the pressure of the fuel in the opposite side of the discharge valve seat 811, which is in the inside of the discharge tubular portion 71 of the discharge portion 70 and is opposite from the pressurizing chamber 107. Thereby, it is possible to limit, for example, a damage of the pipe 6 connected to the discharge portion 70.

In the present embodiment, due to the above-described structure, which releases the high pressure fuel to the gap s1 placed relatively close to the pressurizing chamber 107 at the valve opening time of the relief valve, it is possible to reduce an influence of the fuel pressure relative to the members, such as the pipe 4 and the fuel pump 3, which are placed under the low pressure environment, in comparison to the structure that releases the high pressure fuel to, for example, the fuel chamber 300.

As shown in FIG. 7, in the present embodiment, the relief valve device 85 is placed at the location that is displaced from the axes Ax4 of the receiving through-holes 900 and the imaginary tubular surfaces VT1.

Furthermore, in the present embodiment, the fuel chamber forming portion 30, the discharge portion 70 and the connector 69 are respectively placed at the corresponding locations that are displaced from the locations of the fuel chamber forming portion 30, the discharge portion 70 and the connector 69 of the first embodiment in the circumferential direction of the housing main body 11 and are displaced from the axes Ax4 and the imaginary tubular surfaces VT1. The discharge portion 70 and the connector 69 are placed to face different directions, respectively, which are different from each other.

The rest of the third embodiment, which is other than the above described points, is the same as that of the first embodiment.

As discussed above, (11) in the present embodiment, there is also provided the relief valve device 85.

The relief valve device 85 can release the fuel in the discharge portion 70 to the pressurizing chamber 107 side of the discharge portion 70 when the pressure of the fuel in the discharge portion 70 becomes equal to or larger than the predetermined value. Thereby, it is possible to limit, for example, a damage of the pipe 6 connected to the discharge portion 70.

The relief valve device 85 is placed at the location that is displaced from the axes Ax4 of the receiving through-holes 900 and the imaginary tubular surfaces VT1. Thus, it is possible to limit the interference of the tool 16, which is used to fix the fixable portions 90 of the high pressure pump 1 to the engine 9 with the bolts 91, relative to the relief valve device 85. In this way, the installation of the high pressure pump to the engine 9 is eased.

Fourth Embodiment

Figure 8:
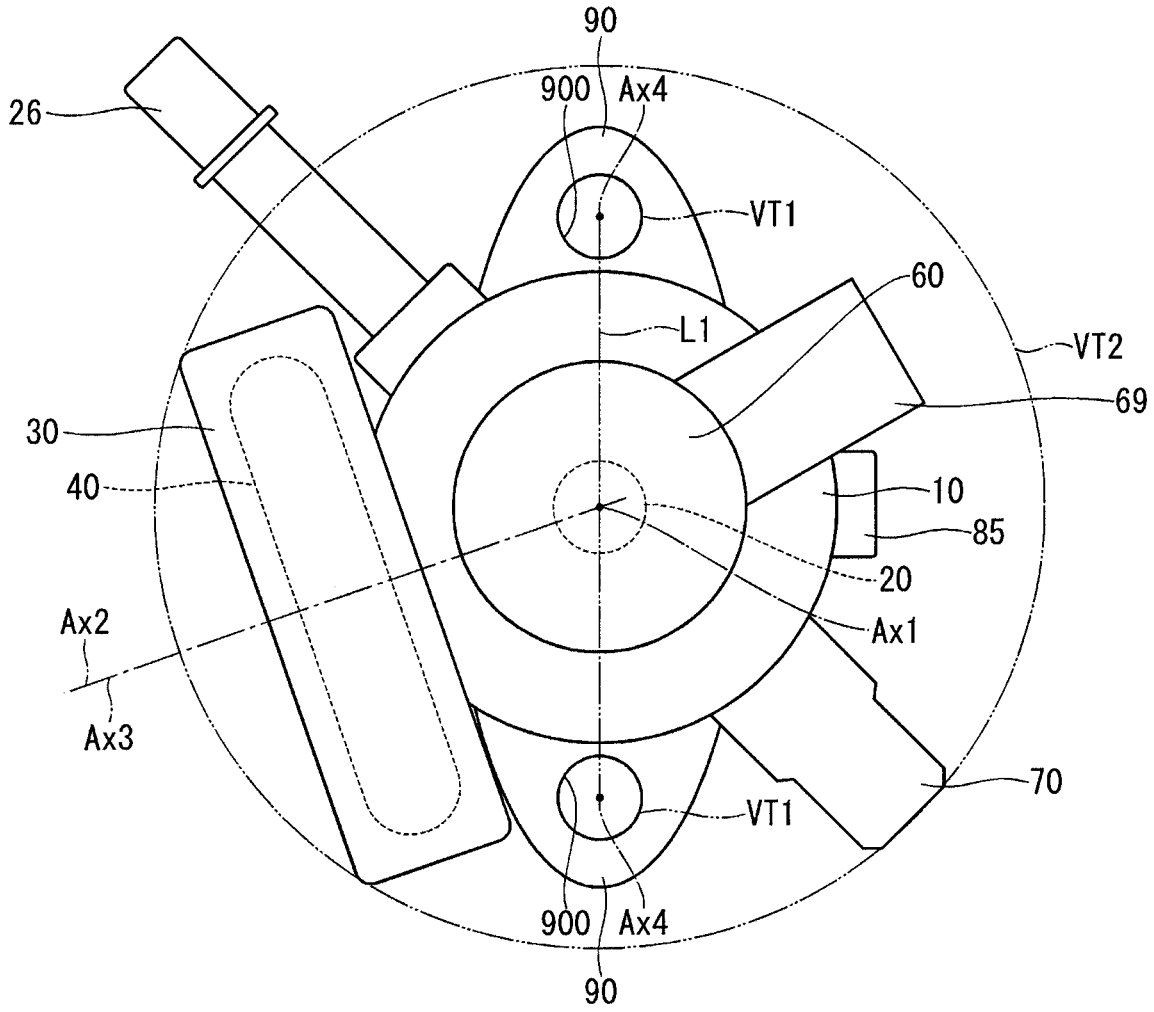
FIG. 8 is a schematic diagram showing a high pressure pump according to a fourth embodiment of the present disclosure.

FIG. 8 shows a high pressure pump according to a fourth embodiment of the present disclosure. The fourth embodiment differs from the third embodiment with respect to, for example, the location of the relief valve device 85 and the location of the inlet portion 26.

In the fourth embodiment, the relief valve device 85 is placed to project outwardly from the outer wall of the housing main body 11 of the housing 10 in the radial direction. The relief valve device 85 is placed along the imaginary plane that passes through the discharge portion 70 and is perpendicular to the axis Ax1 of the plunger 20.

Furthermore, in the fourth embodiment, the inlet portion 26 is placed to connect with the outer wall of the housing main body 11. The space in the inside of the inlet portion 26 is communicated with the inflow hole 101 of the housing main body 11.

As shown in FIG. 8, the relief valve device 85 and the inlet portion 26 are respectively placed at the corresponding locations that are displaced from the axes Ax4 of the receiving through-holes 900 and the imaginary tubular surfaces VT1. The inlet portion 26 is placed such that an opposite end part of the inlet portion 26, which is opposite from the housing main body 11, is placed on an outer side of the imaginary cylindrical surface VT2.

The rest of the fourth embodiment, which is other than the above described points, is the same as that of the third embodiment.

As discussed above, (9) according to the present embodiment, the inlet portion 26 is connected to the housing 10. This specifically exemplifies the construction of the present embodiment.

Furthermore, (10) in the present embodiment, the inlet portion 26 is placed at the location that is displaced from the axes Ax4 of the receiving through-holes 900 and the imaginary tubular surfaces VT1.

Furthermore, (11) in the present embodiment, the relief valve device 85 is placed at the location that is displaced from the axes Ax4 of the receiving through-holes 900 and the imaginary tubular surfaces VT1. Thus, it is possible to limit the interference of the tool 16, which is used to fix the fixable portions 90 of the high pressure pump 1 to the engine 9 with the bolts 91, relative to the inlet portion 26 and the relief valve device 85. In this way, the installation of the high pressure pump to the engine 9 is eased.

Fifth Embodiment

Figure 9:
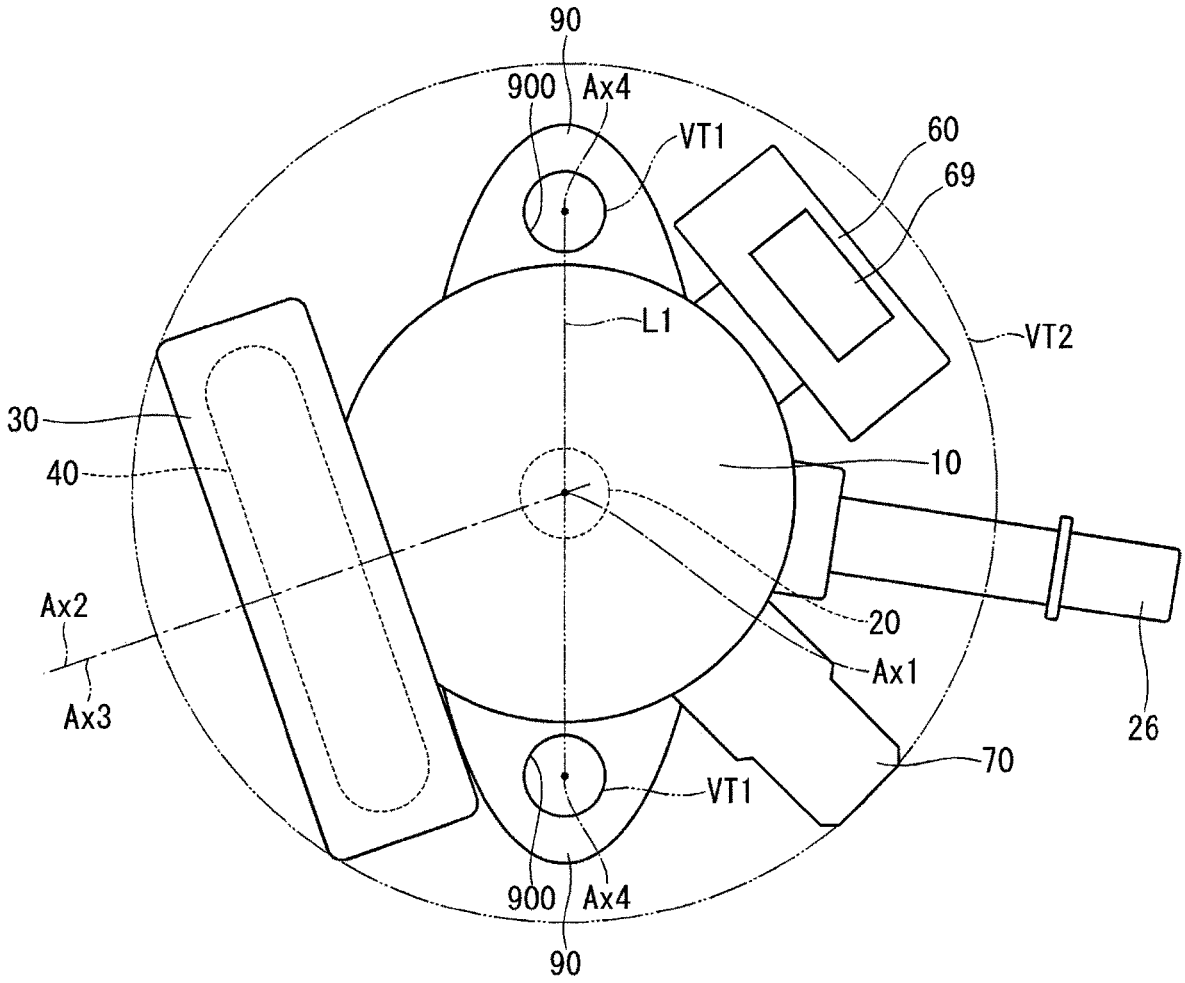
FIG. 9 is a schematic diagram showing a high pressure pump according to a fifth embodiment of the present disclosure.

FIG. 9 shows a high pressure pump according to a fifth embodiment of the present disclosure. The fifth embodiment differs from the fourth embodiment with respect to, for example, the location of the electromagnetic drive device 60 and the location of the inlet portion 26.

In the fifth embodiment, the electromagnetic drive device 60 is placed to project outwardly from the outer wall of the housing main body 11 of the housing 10 in the radial direction. The connector 69 is placed to face in a direction that is generally parallel to the axis Ax1 of the plunger 20.

The inlet portion 26 is placed to connect with the outer wall of the housing main body 11 at a location that is between the electromagnetic drive device 60 and the discharge portion 70.

Here, the electromagnetic drive device 60, the connector 69 and the inlet portion 26 are displaced from the axes Ax4 of the receiving through-holes 900 and the imaginary tubular surfaces VT1.

In the fifth embodiment, the relief valve device 85 of the fourth embodiment is eliminated.

The rest of the fifth embodiment, which is other than the above described points, is the same as that of the fourth embodiment.

Sixth Embodiment

Figure 10:
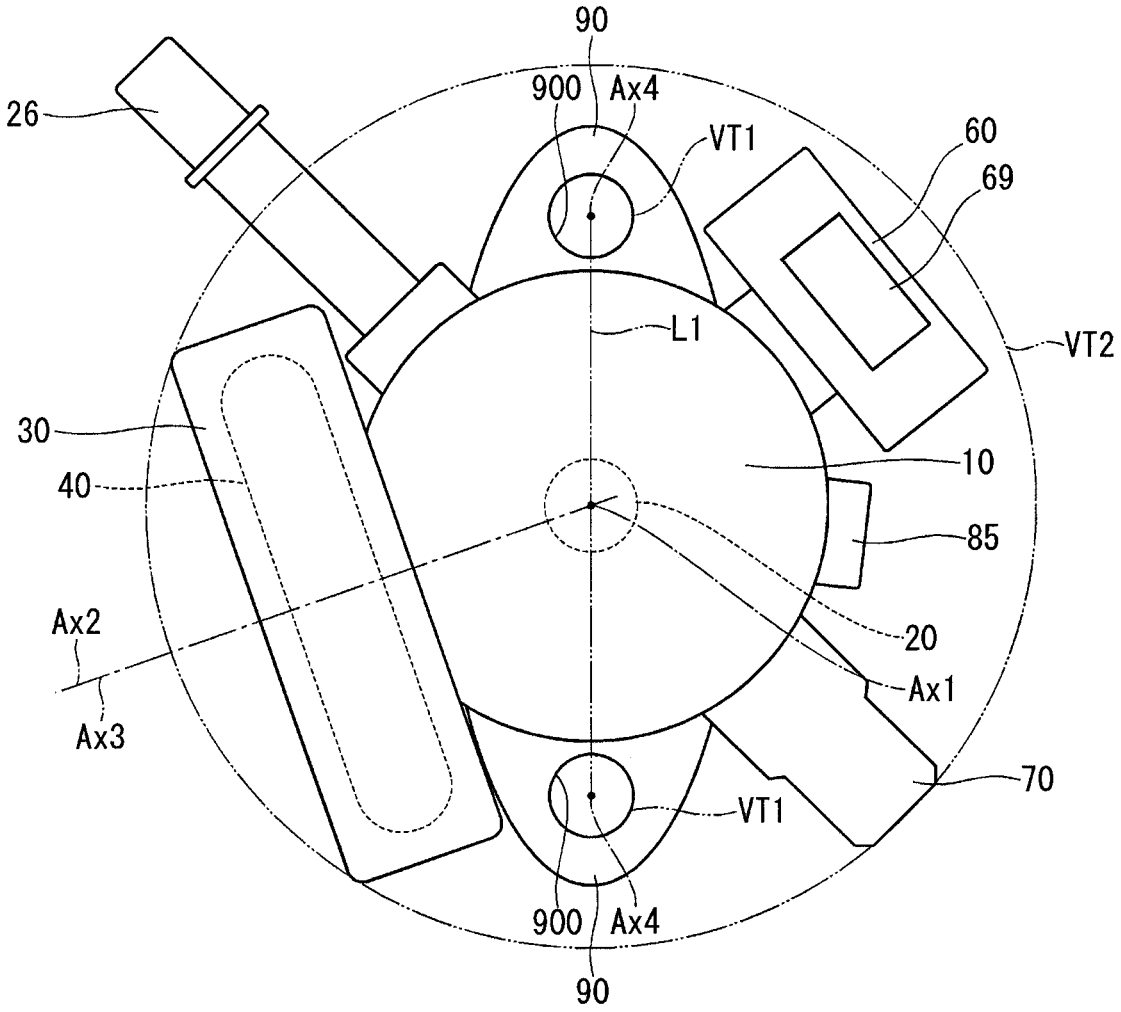
FIG. 10 is a schematic diagram showing a high pressure pump according to a sixth embodiment of the present disclosure.

FIG. 10 shows a high pressure pump according to a sixth embodiment of the present disclosure. The sixth embodiment differs from the fourth embodiment with respect to the location of the electromagnetic drive device 60.

In the sixth embodiment, similar to the fifth embodiment, the electromagnetic drive device 60 is placed to project outwardly from the outer wall of the housing main body 11 of the housing 10 in the radial direction. Similar to the fifth embodiment, the connector 69 is placed to face in the direction that is generally parallel to the axis Ax1 of the plunger 20. The electromagnetic drive device 60 is placed at the outer wall of the housing main body 11 at a location between the relief valve device 85 and the fixable portion 90.

The rest of the sixth embodiment, which is other than the above described points, is the same as that of the fourth embodiment.

Seventh Embodiment

Figure 11:
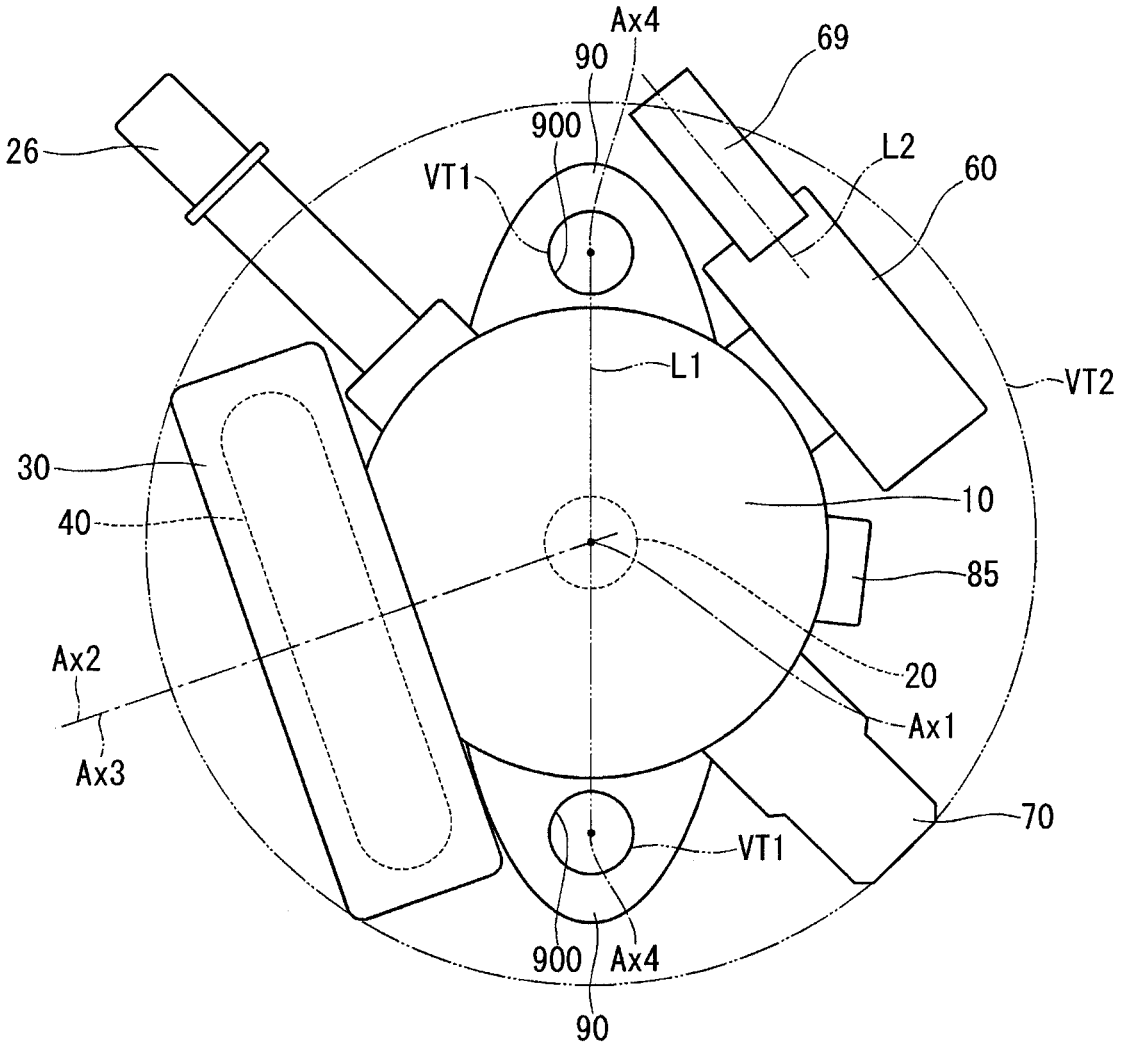
FIG. 11 is a schematic diagram showing a high pressure pump according to a seventh embodiment of the present disclosure.

FIG. 11 shows a high pressure pump according to a seventh embodiment of the present disclosure. The seventh embodiment differs from the sixth embodiment with respect to the orientation of the connector 69 of the electromagnetic drive device 60.

In the seventh embodiment, the connector 69 of the electromagnetic drive device 60 is placed to face in a direction that is skew to the axis Ax1 of the plunger 20. A straight line L2 extends along this direction, in which the connector 69 of the electromagnetic drive device 60 faces, and an angle between the straight line L2 and the axis Ax1 is a generally right angle. Furthermore, the straight line L2 is generally parallel with the axis of the inlet portion 26.

The rest of the seventh embodiment, which is other than the above described points, is the same as that of the sixth embodiment.

Eighth Embodiment

Figure 12:
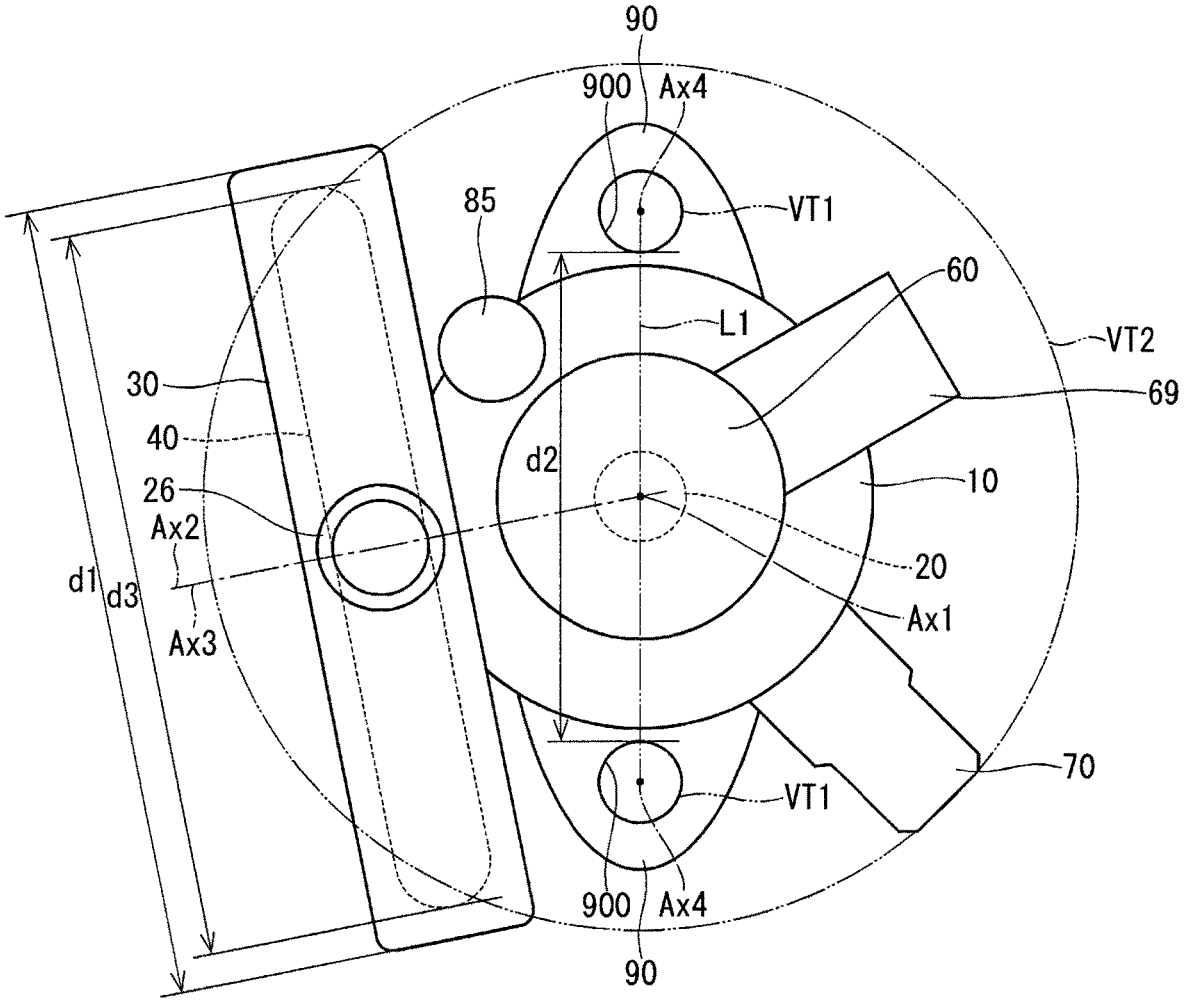
FIG. 12 is a schematic diagram showing a high pressure pump according to an eighth embodiment of the present disclosure.

FIG. 12 shows a high pressure pump according to an eighth embodiment of the present disclosure. The eighth embodiment differs from the third embodiment with respect to a size of the fuel chamber forming portion 30 and a size of the pulsation damper 40.

In the eighth embodiment, the outer diameter d1 of the fuel chamber forming portion 30 is larger than the distance d2 between the two receiving through-holes 900. The outer diameter d3 of the pulsation damper 40 is larger than the distance d2 between the two receiving through-holes 900.

A portion of the fuel chamber forming portion 30 and a portion of the pulsation damper 40 are placed on the outer side of the imaginary cylindrical surface VT2 that circumferentially extends about the axis Ax1 of the plunger 20 along the end part of the discharge portion 70.

The rest of the eighth embodiment, which is other than the above described points, is the same as that of the third embodiment.

In the eighth embodiment, the outer diameter d1 of the fuel chamber forming portion 30 and the outer diameter d3 of the pulsation damper 40 are larger than the distance d2 between the two receiving through-holes 900. Therefore, in comparison to the third embodiment, it is possible to further enhance the pressure pulsation reducing effect of the pulsation damper 40 for reducing the pressure pulsation of the fuel in the fuel chamber 300 in comparison to the third embodiment.

Ninth Embodiment

Figure 13:
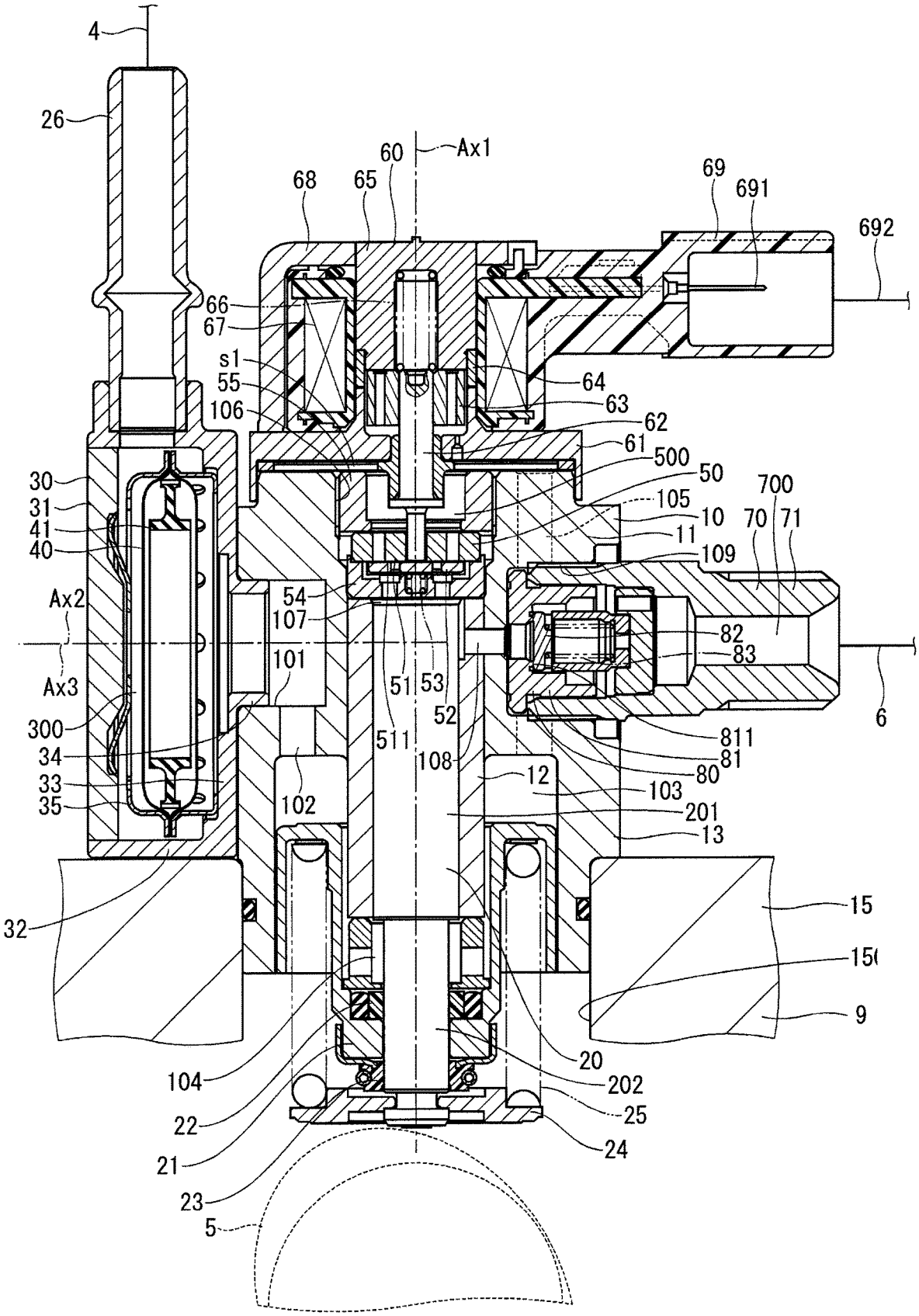
FIG. 13 is a cross-sectional view of a high pressure pump according to a ninth embodiment of the present disclosure.

FIG. 13 shows a high pressure pump according to a ninth embodiment of the present disclosure. The ninth embodiment differs from the first embodiment with respect to, for example, the construction of the housing 10 and the construction of the fuel chamber forming portion 30.

In the ninth embodiment, the cylinder portion 12 is formed separately from the housing main body 11. The cylinder portion 12 is shaped into the generally cylindrical tubular form and has the outer wall that is fitted to the inner wall of the housing main body 11.

In the fuel chamber forming portion 30, the plate portion 31 is formed separately from the tubular portion 32. The tubular portion 32 is formed integrally with the plate portion 33 in one piece. The plate portion 31 is placed to close the opposite side of the tubular portion 32, which is opposite from the tubular portion 34.

The rest of the ninth embodiment, which is other than the above described points, is the same as that of the first embodiment.

Tenth Embodiment

Figure 14:
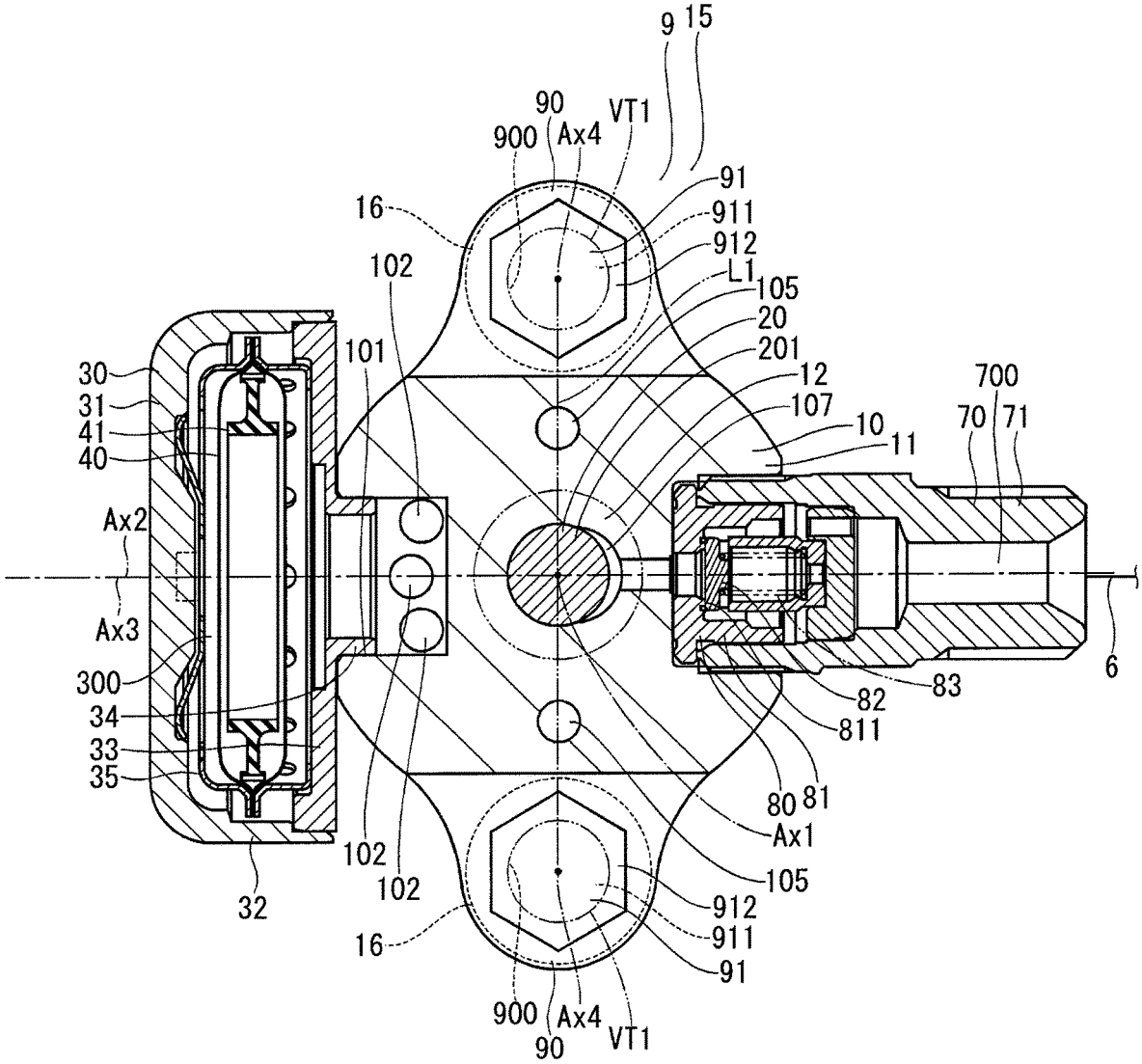
FIG. 14 is a cross-sectional view of a high pressure pump according to a tenth embodiment of the present disclosure.

FIG. 14 shows a high pressure pump according to a tenth embodiment of the present disclosure. The tenth embodiment is different from the first embodiment with respect to the construction of the respective fixable portions 90.

In the tenth embodiment, the fixable portions 90 are formed separately from the housing main body 11. An end surface of each fixable portion 90, which is opposite from the engine head 15, is located on, for example, the engine head 15 side of the axis Ax2 of the fuel chamber forming portion 30.

The rest of the tenth embodiment, which is other than the above described points, is the same as that of the first embodiment.

Other Embodiments

In another embodiment of the present disclosure, the fuel chamber forming portion 30 may be placed at a location, in which the imaginary tubular surfaces VT1 extend, as long as this location is displaced from the axes Ax4 of the receiving through-holes 900.

In another embodiment of the present disclosure, each fixing member is not necessarily limited to the bolt 91 and the nut 92, and as long as the fixing member is formed to correspond with the receiving through-hole 900, the fixing member may be any other type of member that fixes the fixable portion 90.

In another embodiment of the present disclosure, the pulsation damper 40 may be placed such that the axis Ax3 of the pulsation damper 40 obliquely intersects with the axis Ax1 of the plunger 20. The pulsation damper 40 may be placed such that the axis Ax3 of the pulsation damper 40 is skew to the axis Ax1 of the plunger 20. In this case, the pulsation damper 40 may be placed such that the axis Ax3 of the pulsation damper 40 is skew to the axis Ax1 at a right angle. Specifically, at this time, an angle defined between the axis Ax3 of the pulsation damper 40 and the axis Ax1 of the plunger 20 is the right angle. The angle defined between the two straight lines, which are skew to each other, corresponds to an angle defined between two half-lines that are respectively parallel to the two straight lines and begin from any common single point.

Furthermore, in another embodiment of the present disclosure, the outer diameter d1 of the fuel chamber forming portion 30 may be smaller than the distance d2 between the two receiving through-holes 900.

In another embodiment of the present disclosure, the number of the receiving through-holes 900 may be set to four or more in such a manner that the receiving through-holes 900 are symmetrical to each other with respect to the axis Ax1 of the plunger 20, which serves as the axis of symmetry. Furthermore, the number of the receiving through-holes 900 may be set to three or more in such a manner that the receiving through-holes 900 are arranged one after another at equal intervals in the circumferential direction.

Furthermore, in the first embodiment, there is described the example, in which the inlet portion 26 is connected to the fuel chamber forming portion 30 such that the axis of the inlet portion 26 is generally parallel to the axis Ax1 of the plunger 20. In contrast to this, in another embodiment of the present disclosure, the inlet portion 26 may be connected to the fuel chamber forming portion 30 at any angle in view of the installation space of the high pressure pump at the vehicle and/or the location of the pipe 4. Furthermore, each of the discharge portion 70 and the inlet portion 26 may be connected to the housing main body 11 at any angle in view of the installation space of the high pressure pump at the vehicle and/or the locations of the pipes 4, 6.

Furthermore, the inlet portion 26 may be eliminated.

Furthermore, the connector 69 of the electromagnetic drive device 60 may be arranged relative to the housing main body 11 at any angle in view of the installation space of the high pressure pump at the vehicle and/or the location of the harness 692.

Furthermore, in the above embodiments, there is described the example where the relief valve device 85 releases the fuel at the opposite side of the discharge valve seat 811, which is in the inside of the discharge tubular portion 71 of the discharge portion 70 and is opposite from the pressurizing chamber 107, to the gap s1 between the housing main body 11 and the yoke 61. In contrast, in another embodiment of the present disclosure, the relief valve device 85 may release the fuel in the inside of the discharge tubular portion 71 of the discharge portion 70 to, for example, the space, which includes the pressurizing chamber 107 that is located between the suction valve 52 and the discharge valve 82 and has the relatively high pressure; or to the inflow hole 101 and/or the fuel chamber 300 that has the relatively low pressure.

In another embodiment of the present disclosure, the vibration limiting member 41 at the inside of the pulsation damper 40 may be eliminated.

In another embodiment of the present disclosure, the fuel chamber forming portion 30 may be formed integrally with the housing main body 11 in one piece.

Furthermore, in another embodiment of the present disclosure, the high pressure pump may be used as a fuel pump that discharges the fuel to a device that is other than the engine of the vehicle.

As discussed above, the present disclosure should not be limited to the above embodiments and may be implemented in various forms without departing from the scope of the present disclosure.

The invention claimed is:

1. A high pressure pump configured to be installed to an internal combustion engine to pressurize, discharge and supply fuel to the internal combustion engine, the high pressure pump comprising:

a housing that includes a pressurizing chamber;

a plunger that is movable in such a manner that the plunger increases and decreases a volume of the pressurizing chamber upon movement of the plunger, and thereby the plunger is operable to pressurize the fuel in the pressurizing chamber;

a fuel chamber forming portion that is placed on a radially outer side of the plunger and forms a fuel chamber that is communicated with the pressurizing chamber, wherein the fuel chamber forming portion includes a casing, which forms the fuel chamber at an inside of the casing while the casing is formed separately from the housing and is installed to an outer peripheral wall of the housing, and the fuel chamber is defined between one wall portion and another wall portion of the casing in a radial direction of an axis of the plunger;

a pulsation damper that is placed in an inside of the fuel chamber of the casing and is operable to reduce pressure pulsation of the fuel in the fuel chamber, wherein the pulsation damper is held between the one wall portion and the another wall portion of the casing in the radial direction;

a discharge portion that discharges the fuel, which is pressurized in the pressurizing chamber; and a fixable portion that is placed on the radially outer side of the plunger and includes a receiving through-hole while the fixable portion is configured to be fixed to the internal combustion engine with a fixing member that is formed to correspond with the receiving through-hole, wherein:

the fuel chamber forming portion is placed at a location that is displaced from an axis of the receiving through-hole;

the casing, the fixable portion and the discharge portion are entirely placed on an inner side of an imaginary cylindrical surface that circumferentially extends about the axis of the plunger along an end part of the discharge portion; and the fixable portion is configured to be directly fixed to an engine head of the internal combustion engine with the fixing member.

2. The high pressure pump according to claim 1, wherein the casing is placed at the location that is displaced from an imaginary tubular surface that includes all of an inner wall of the receiving through-hole.

3. The high pressure pump according to claim 1, wherein the fixable portion is fixable to the internal combustion engine through the fixing member when the fixing member is inserted through the receiving through-hole and is fixed to the internal combustion engine, or when the fixing member is fixed to a portion of the internal combustion engine, which is inserted through the receiving through-hole.

4. The high pressure pump according to claim 1, wherein the pulsation damper is shaped into a hollow circular disk form and is placed such that an axis of the pulsation damper intersects with the axis of the plunger, or the axis of the pulsation damper is skew to the axis of the plunger.

5. The high pressure pump according to claim 4, wherein the pulsation damper is placed such that the axis of the pulsation damper is perpendicular to the axis of the plunger or is skew to the axis of the plunger at a right angle.

6. The high pressure pump according to claim 1, wherein the receiving through-hole is one of a plurality of receiving through-holes that are symmetrical to each other with respect to the axis of the plunger, which serves as an axis of symmetry.

7. The high pressure pump according to claim 6, wherein the casing is shaped into a hollow circular disk form and has an outer diameter that is larger than a distance between the plurality of receiving through-holes.

8. The high pressure pump according to claim 1, further comprising an inlet portion that is shaped into a tubular form while the inlet portion is communicated with the fuel chamber and guides the fuel from an outside to the fuel chamber, wherein the inlet portion is joined to the casing.

9. The high pressure pump according to claim 1, further comprising an inlet portion that is shaped into a tubular form while the inlet portion is communicated with the pressurizing chamber and guides the fuel from an outside to the fuel chamber, wherein the inlet portion is joined to the housing.

10. The high pressure pump according to claim 8, wherein the inlet portion is placed at a location that is displaced from the axis of the receiving through-hole.

11. The high pressure pump according to claim 1, further comprising a relief valve device that is operable to release the fuel in the discharge portion toward the pressurizing chamber side of the discharge portion when a pressure of the fuel in the discharge portion becomes equal to or larger than a predetermined value, wherein the relief valve device is placed at a location that is displaced from the axis of the receiving through-hole.

12. The high pressure pump according to claim 1, further comprising:

a suction valve device that is operable to open and close a connection between the pressurizing chamber and the fuel chamber; and an electromagnetic drive device that is operable upon energization of the electromagnetic drive device to drive the suction valve device to open or close the connection between the pressurizing chamber and the fuel chamber, wherein the electromagnetic drive device is placed at a location that is displaced from the axis of the receiving through-hole.

13. The high pressure pump according to claim 12, wherein the electromagnetic drive device is placed along the axis of the plunger.

14. The high pressure pump according to claim 12, wherein the electromagnetic drive device is placed on the radially outer side of the plunger.

15. The high pressure pump according to claim 12, wherein:

the electromagnetic drive device includes a connector, to which a harness for supplying an electric power is connectable; and the connector is placed at a location that is displaced from the axis of the receiving through-hole.

16. A high pressure pump configured to be installed to an internal combustion engine to pressurize, discharge and supply fuel to the internal combustion engine, the high pressure pump comprising:

a housing that includes a pressurizing chamber;

a plunger that is movable in such a manner that the plunger increases and decreases a volume of the pressurizing chamber upon movement of the plunger, and thereby the plunger is operable to pressurize the fuel in the pressurizing chamber;

a fuel chamber forming portion that is placed on a radially outer side of the plunger and forms a fuel chamber that is communicated with the pressurizing chamber, wherein the fuel chamber forming portion includes a casing, which forms the fuel chamber at an inside of the casing while the casing is formed separately from the housing and is installed to an outer peripheral wall of the housing, and the fuel chamber is defined between one wall portion and another wall portion of the casing in a radial direction of an axis of the plunger;

a pulsation damper that is placed in an inside of the fuel chamber of the casing and is operable to reduce pressure pulsation of the fuel in the fuel chamber, wherein the pulsation damper is held between the one wall portion and the another wall portion of the casing in the radial direction;

a discharge portion that discharges the fuel, which is pressurized in the pressurizing chamber; and a fixable portion that is placed on the radially outer side of the plunger and includes a receiving through-hole while the fixable portion is configured to be fixed to the internal combustion engine with a fixing member that is formed to correspond with the receiving through-hole, wherein:

the casing is placed at a location that is displaced from an axis of the receiving through-hole;

a portion of the casing, an entirety of the fixable portion and an entirety of the discharge portion are placed on an inner side of an imaginary cylindrical surface that circumferentially extends about the axis of the plunger along an end part of the discharge portion;

another portion of the casing is placed on an outer side of the imaginary cylindrical surface; and the fixable portion is configured to be directly fixed to an engine head of the internal combustion engine with the fixing member.

17. The high pressure pump according to claim 1, further comprising a bolt inserted through the receiving through-hole of the fixable portion and into a fixation hole of the engine head of the internal combustion engine.

* * * * *